US010238157B2

(12) United States Patent
Nordstrom

(10) Patent No.: US 10,238,157 B2
(45) Date of Patent: Mar. 26, 2019

(54) MOTION-ACTIVATED VENTING SYSTEM

(71) Applicant: NIKE, Inc., Beaverton, OR (US)

(72) Inventor: Matthew D. Nordstrom, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 125 days.

(21) Appl. No.: 15/259,843

(22) Filed: Sep. 8, 2016

(65) Prior Publication Data

US 2017/0065005 A1 Mar. 9, 2017

Related U.S. Application Data

(60) Provisional application No. 62/216,147, filed on Sep. 9, 2015.

(51) Int. Cl.
*A41D 27/28* (2006.01)
*A41D 13/002* (2006.01)
(Continued)

(52) U.S. Cl.
CPC ..... *A41D 13/002* (2013.01); *A41B 1/00* (2013.01); *A41D 1/02* (2013.01); *A41D 1/04* (2013.01);
(Continued)

(58) Field of Classification Search
CPC ..... A41D 27/28; A41D 1/02; A41D 13/002; A41D 2400/20; A41D 3/00;
(Continued)

(56) References Cited

U.S. PATENT DOCUMENTS 317,711 A * 5/1885 Brinkman ..... A41D 27/28 2/118
385,306 A * 6/1888 Helwitz ..... A41D 27/28 2/87
(Continued)

FOREIGN PATENT DOCUMENTS

CA 2835752 A1 6/2014
GB 453117 A 9/1936
(Continued)

OTHER PUBLICATIONS

"Women's Eat My Dust Skirt," thenorthface.com Last Accessed Dec. 2, 2014 at: http://www.thenorthface.com/catalog/sc-gear/womens-pants-shorts-filter-categorydresses_skirts/women-8217-s-eat-my-dust-skirt.html?from=subCat&variationId=R9V.
(Continued)

*Primary Examiner* — Robert H Muromoto, Jr.
(74) *Attorney, Agent, or Firm* — Shook Hardy & Bacon, LLP

(57) ABSTRACT

A motion-activated venting system for incorporation into an article of apparel is described herein. The motion-activated venting system may comprise a variety of pleats having one or more folded edges and a ventilation region having a plurality of apertures. In a first state, the one or more folded edges overlie the ventilation region such that the plurality of apertures is covered. In a second state, the one or more folded edges are remote from the ventilation region such that the plurality of apertures is exposed. Further, in an intermediate state, the motion-activated venting system is partially open, thereby exposing a portion of the plurality of apertures.

20 Claims, 17 Drawing Sheets

(51) Int. Cl.

| | |
|---|---|
| ***A41B 1/00*** | (2006.01) |
| ***A41D 1/02*** | (2006.01) |
| ***A41D 1/04*** | (2006.01) |
| ***A41D 3/02*** | (2006.01) |
| ***A41D 27/10*** | (2006.01) |
| ***A41D 1/08*** | (2018.01) |
| ***A41H 33/00*** | (2006.01) |
| ***B26D 3/12*** | (2006.01) |
| *A41D 27/00* | (2006.01) |

(52) U.S. Cl.
CPC ..... *A41D 1/08* (2013.01); *A41D 3/02* (2013.01); *A41D 27/10* (2013.01); *A41D 27/28* (2013.01); *A41D 27/285* (2013.01); *A41H 33/00* (2013.01); *B26D 3/12* (2013.01); *A41D 2300/24* (2013.01); *A41D 2400/20* (2013.01); *A41D 2600/10* (2013.01)

(58) Field of Classification Search
CPC ..... A41D 13/0015; A41D 2600/102; A41D 13/0053; A41D 13/0056; A41D 1/04; A41D 31/0038; A41D 3/04
See application file for complete search history.

(56) References Cited

U.S. PATENT DOCUMENTS 606,898 A * 7/1898 Schoen ..... A41B 1/02 2/118
1,015,231 A * 1/1912 Jacobs ..... A41D 1/02 2/115
1,326,517 A * 12/1919 Lieberman ..... A41D 1/02 2/93
2,114,514 A * 4/1938 York ..... A41D 27/28 2/93
2,131,515 A * 9/1938 Jonas ..... A41D 1/02 2/93
2,322,451 A * 6/1943 Jones ..... A41D 1/02 2/93
2,458,004 A * 1/1949 Kerr ..... A41D 3/00 2/93
2,631,290 A * 3/1953 Klepper ..... A41D 27/28 2/87
3,296,626 A * 1/1967 Ludwikowski ..... A41D 27/28 2/87
4,408,356 A * 10/1983 Abrams ..... A41D 27/28 2/87
5,727,256 A * 3/1998 Rudman ..... A41D 27/28 2/115
D457,709 S * 5/2002 Davis ..... D2/717
D491,713 S * 6/2004 Wilson, II ..... D2/849
6,792,621 B2 * 9/2004 Braun ..... A41D 27/285 2/1
7,043,766 B1 * 5/2006 Foreman ..... A41B 9/06 2/69
7,762,432 B2 * 7/2010 Fidrych ..... A45F 3/20 222/175
D643,597 S * 8/2011 Gaeir ..... D2/840
8,001,618 B2 * 8/2011 Bay ..... A41D 27/28 2/93
8,133,824 B2 * 3/2012 Harber ..... A41D 1/04 156/209
D657,532 S * 4/2012 Gaeir ..... D2/840
8,187,984 B2 * 5/2012 Rock ..... A41D 31/0038 442/59
8,555,414 B2 * 10/2013 Davis ..... A41D 13/0053 2/115
D704,419 S * 5/2014 Holmes ..... D2/839
8,713,712 B2 * 5/2014 Maurer ..... A41D 27/24 135/93
D709,269 S * 7/2014 Kenney ..... D2/717
8,850,615 B2 * 10/2014 Demarest ..... A41D 27/28 2/69
2002/0146361 A1 * 10/2002 Gardner ..... A61L 9/03 422/306
2004/0092375 A1 * 5/2004 Pansier ..... B65B 1/18 493/195
2005/0204449 A1 * 9/2005 Baron ..... A41D 1/04 2/69
2006/0041990 A1 * 3/2006 Alesina ..... A41D 27/28 2/93
2006/0059601 A1 * 3/2006 Opitz ..... A41D 3/00 2/108
2006/0179539 A1 * 8/2006 Harber ..... A41D 13/002 2/69
2006/0277652 A1 * 12/2006 Okajima ..... A41D 13/00 2/93
2009/0235800 A1 * 9/2009 Germaine ..... B26D 5/00 83/659
2012/0090794 A1 * 4/2012 Serio ..... A47H 1/04 160/237
2013/0333092 A1 * 12/2013 Hodgson ..... A41D 3/04 2/69
2014/0041285 A1 * 2/2014 Russell ..... A01K 13/006 43/132.1
2014/0157497 A1 * 6/2014 Audet ..... A41D 27/28 2/455
2014/0196192 A1 * 7/2014 Koller ..... A41D 3/02 2/85
2017/0065005 A1 * 3/2017 Nordstrom ..... A41D 13/002

FOREIGN PATENT DOCUMENTS

GB 658509 A 10/1951
GB 2245477 A 1/1992

OTHER PUBLICATIONS

"Men's Madison River Shirt with Insect Shield," railriders.com, Item # MRVIS. Last Accessed Dec. 2, 2014 at: http://www.railriders.com/men-madison-river-shirt-with-insect-shield-p-881.html.
"The North Face Wrencher Jersey," backcountryskiingcanada.com Last Accessed Dec. 2, 2014 at: http://www.rei.com/product/846560/the-north-face-wrencher-bike-jerseymens/backcountryskiingcanada.com/index.php?p=page&page_id=The%20North%20Face%20Downieville%20Colab%20Shorts%20and%20Wrencher%20Jersey.
"Abisko Vent Shirt LS," fjallravencanada.com Last Accessed Dec. 2, 2014 at: http://www.fjallravencanada.com/abisko-vent-shirt-ls.html.
International Search Report and Written Opinion dated Dec. 6, 2016 in International Application No. PCT/US2016/050995, 12 pages.
International Preliminary Report on Patentability dated Mar. 22, 2018 in International Patent Application No. PCT/US2016/050995, 8 pages.

* cited by examiner

MOTION-ACTIVATED VENTING SYSTEM

This application claims the benefit of U.S. Provisional Application No. 62/216,147, filed Sep. 9, 2015, and entitled "Motion-activated Venting System." The entirety of the aforementioned application is incorporated by reference herein.

TECHNICAL FIELD

The present disclosure relates to a venting system for incorporation into articles of apparel. More specifically, the present disclosure relates to a motion-activated venting system that provides enhanced ventilation to a wearer of an article of apparel when the wearer is active.

BACKGROUND

Traditionally, apparel has failed to provide dynamic ventilation. Particularly for those engaged in exercise or other physical activity, regulating body temperature is problematic. For example, a shirt may feel appropriate for the ambient temperature before a wearer begins a run. However, once a person has begun running, they may find the same shirt is causing them discomfort because their body temperature has increased. Traditionally, to deal with changes in temperature due to physical activity, people have had to wear multiple layers of clothing. However, once a person's body temperature has increased, the layers of clothing have to be removed to avoid discomfort and allow body heat to dissipate. Additionally, once physical activity has ceased, a person often desires to retain heat as the body begins to cool. The traditional solution to this problem has been to add additional layers. This creates several problems. First, it is very inconvenient to stop and remove layers during exercise, and the wearer is often forced to carry their removed clothing for the remainder of their activity. Second, once physical activity has ceased, the wearer begins to lose body heat. In addition to causing the wearer discomfort, this loss in body heat may lead to muscle tightness and possible injury.

Additionally, increased body temperature can be concentrated at specific areas of the body, for example, at the upper back. As a result, different areas of the body require different quantities of ventilation to maintain comfort and dissipate body heat during physical activity. Past solutions have failed to adequately address this issue.

BRIEF SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The present invention is defined by the claims.

At a high level, aspects described herein relate to motion-activated venting systems that can be incorporated into articles of apparel. The motion-activated venting systems described herein function as a valve; they are adapted to open when the wearer is active and to close when the wearer is inactive. As a result, the motion-activated venting systems described herein dynamically and automatically enhance ventilation when the wearer is physically active. Additionally, the motion-activated venting systems decrease ventilation when the wearer is sedentary, allowing the wearer to retain heat. Further, specific regions of the body produce and attract more heat than others. Advantageously, the motion-activated venting systems described herein can be incorporated into an article of apparel at any desirable location. For example, the upper back attracts and produces an abundance of heat. Incorporating a motion-activated venting system at the upper back portion of the apparel item provides the wearer increased comfort by enhancing ventilation at the heat producing region while the wearer is active. Further, multiple combinations of the various aspects of the motion-activated venting systems described herein can also be incorporated into and placed at various locations of an article of apparel. As a result, the motion-activated venting system can be employed to achieve desired ventilation properties based on the intended use of the article of apparel and the preferences of the wearer.

The motion-activated venting system may be embodied as various forms of pleats or pleat structures. In one aspect, the pleat structures may be formed from the material used to form the article of apparel, and in another aspect, the pleat structures may take the form of an insert that is incorporated into the article of apparel. Any and all such aspects, and any variation thereof, are contemplated as being within the scope herein. In exemplary aspects, the pleat structure may comprise one or more folded edges that overlie a set of apertures formed through the material of the article of apparel in a first, inactive state, and are positioned away from the set of apertures in a second, active state, such that the apertures are exposed to the external environment. Further, the pleat structure may provide an inner-facing surface of the article of apparel that is proximate or adjacent a wearer's body in the inactive state, and that is spaced apart (at least in part, e.g., proximate the pleat structure) from the wearer's body in the active state. To put it another way, the term "first, inactive state" refers to the state of a pleat structure when the wearer of the article of apparel is stationary. As a result, when the pleat is in the first, inactive state, the pleat is effectively closed, meaning that the set of apertures is covered or substantially covered. Further, the term "second, active state" refers to the state of the pleat structure when the wearer of the article of apparel is ambulatory. As a result, when a pleat is in the second, active state, the pleat is effectively open, meaning that the plurality of apertures is uncovered or substantially uncovered, and that provides an inner-facing surface that stands-off from the body of the wearer. Additionally, the term "intermediate state" refers to the state of a pleat that is open to a degree between the first state and the second state. As such, when a pleat is in the intermediate state, a portion of the apertures may be covered and a portion of the apertures may be uncovered. Said differently, the intermediate state refers to the state of a pleat that is partially open and partially closed. As can be appreciated, the intermediate state may refer to the pleat in any state between the first and the second state.

In an aspect herein, the pleats described may have at least a first fold having a first folded edge and a ventilation region. The ventilation region may comprise a plurality of apertures and/or may be in the form of a mesh material. In other aspects, a pleat may additionally have a second fold or a second portion having a second folded edge. When the pleat is in a first, inactive state, the plurality of apertures are covered or substantially covered by the first fold and/or the second fold due to the folded configuration of the pleat. This allows the wearer to retain body heat before physical activity has begun or after physical activity has ceased. Conversely, when the pleat is in a second, active state, the plurality of apertures is exposed. The edges and folds of the various pleats automatically move away from one another when the wearer is active due to airflow created by the motion of the wearer and/or the tension or stretch forces created by the body of the wearer and the wearer's movement. Consequently, the plurality of apertures of the ventilation region is exposed. Additionally, the degree to which the edges and folds of the pleats move away from one another corresponds to the amount of airflow and tension/stretch forces. As a result, a greater degree of ventilation is provided to the wearer by virtue of exposure of the plurality of apertures, which allow airflow to cool the body of the wearer and/or for the body heat of the wearer to dissipate.

In one aspect, a pleat may be configured as a box pleat or an inverted box pleat. The box pleat may comprise a first fold and an opposite second fold. As used herein, the term "opposite" may refer to a feature that is located adjacent to, but separate from, another feature, or to a feature that is facing another feature. Continuing, the first fold terminates in a first folded edge and the second fold terminates in a second folded edge. A ventilation region is interposed between the first fold and the second fold. Further, the ventilation region has a plurality of apertures and/or a mesh material. The plurality of apertures are covered or substantially covered by the first fold and the second fold when the motion-activated venting system is in a first, inactive state. As used herein, the term "cover" may indicate that a feature occludes, lies on or over, or obstructs the visibility of another feature. This allows the wearer to retain body heat before physical activity has begun or after physical activity has ceased. When the box pleat is in the second, active state, the first fold and the second fold move away from one another, exposing the plurality of apertures and providing enhanced ventilation.

In additional aspects, the motion-activated venting system may take the form of an accordion pleat. In this aspect, there may be a plurality of folds having creases. Disposed between adjacent creases, there may be a ventilation region with a plurality of apertures and/or a mesh material. Because of the accordion structure, when the accordion pleat is in a first, inactive state, the apertures are unexposed. Conversely, when the accordion pleat is in a second, active state, the accordion pleat expands, exposing the plurality of apertures and thereby providing enhanced ventilation.

The motion-activated venting system may also be embodied in various other forms. For example, the motion-activated venting system may include a knife pleat or a bias pleat. In these configurations, the pleat may have a first folded edge and a ventilation region, the ventilation region having a plurality of apertures. When the pleat is in a first, inactive state, the first edge covers the ventilation region, thereby allowing the wearer to retain body heat. When the pleat is in a second, active state, the plurality of apertures is exposed, thereby providing enhanced ventilation. In other forms, instead of having a plurality of apertures, a mesh material may be used. Thus, when the pleat is in a first, inactive state, the first edge covers the mesh material, thereby allowing the wearer to retain body heat. And when the pleat is in a second, active state, the mesh material is exposed, thereby providing enhanced ventilation.

The venting systems described herein may be located at any desirable location on an article of apparel. Additionally, the venting systems may be incorporated into the same article of apparel at multiple locations to impart the desired degree of ventilation to a wearer of the article of apparel. In some aspects, multiple pleats for venting structures may be selectively located throughout the article of apparel to provide a system that facilitates circulation of air through the article of apparel. For example, the one or more pleat structures may be located on the front surface of the article of apparel, where they can act as inflow vents or intake valves. Continuing with this example, the same article of apparel may include one or more venting structures on the back surface, where they can act as outflow vents. Further, the size of the various pleat structures and apertures described herein may also be modified to achieve desired ventilation properties for an article of apparel, depending on the purpose of the article of apparel. Even further, materials used to create the venting systems herein may have varying breathability and or ventilation properties. For instance, in some aspects, the concentration of apertures may be higher in some locations than others. As a result, the aspects described herein provide for dynamic motion-activated venting systems for incorporation into articles of apparel.

BRIEF DESCRIPTION OF THE DRAWINGS

Examples of the present invention are described in detail below with reference to the attached drawing figures, wherein.

DETAILED DESCRIPTION

Figure 1:
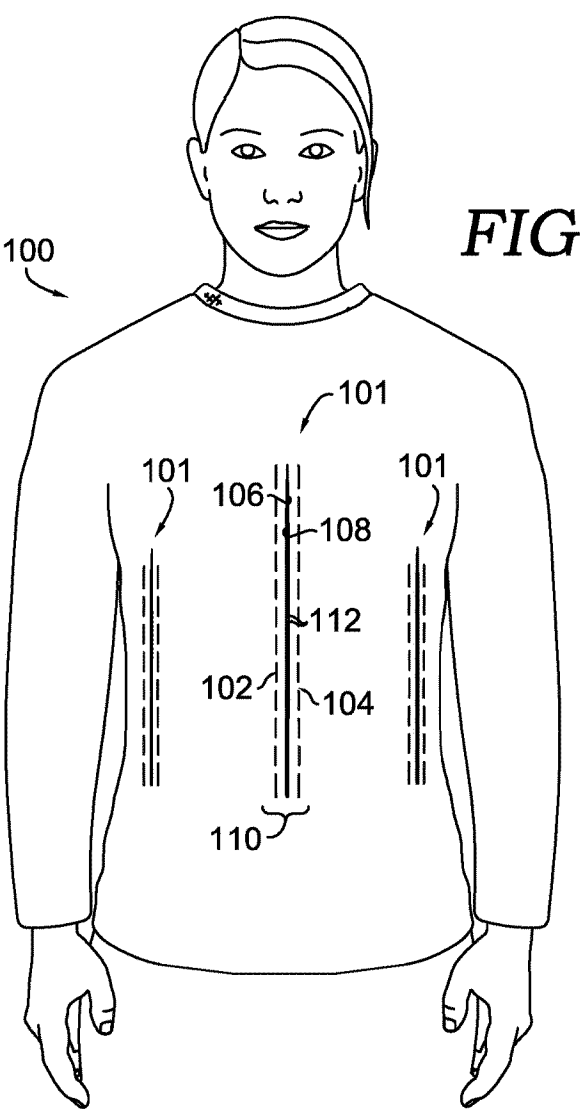
FIG. 1 illustrates a front view of an article of apparel in an as-worn state, where the article of apparel comprises an exemplary motion-activated venting system in the form of one or more box pleats in a first, inactive state in accordance with an aspect herein.

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Aspects herein relate to a motion-activated venting system for incorporation into an article of apparel. In exemplary aspects, the motion-activated venting system may have at least one fold with an edge or a folded edge that overlies a ventilation region having a plurality of apertures and/or a mesh material. As such, the motion-activated venting system may be thought of as having two or more layers. In one aspect, the ventilation region layer may be disposed adjacent to the skin of the wearer and the fold layer located on the external-facing surface of the article of apparel. In other aspects, the ventilation region may be disposed adjacent to one or more apparel base layers. As used herein, the term "fold" generally refers to a portion of a pleat that leads up to an edge or folded edge. In exemplary aspect, the fold may be formed from a single layer of material that is folded to form a two-layer fold. The terms "edge" or "folded edge" as used herein refer to the terminal portion of the fold or where the layer of material turns back onto itself. As such, the folded edge further comprises a two-layer fold when a single layer of material is used to form the fold.

By configuring the motion-activated venting system as described, when the wearer of the article of apparel is in a first, inactive state, the folded edge(s) overlie the plurality of apertures of the ventilation region. Additionally, by configuring the motion-activated venting system as described, when the wearer of the article of apparel is in a second, active state, the folded edge(s) are positioned away from the plurality of apertures such that at least a portion of the plurality of apertures is uncovered. Further, when the wearer of the article of apparel is in a partially active or an intermediate state, the folded edge(s) are positioned away from the plurality of apertures to a degree between the position of the folded edges and the plurality of apertures in the first state and the second state. As used herein, the terms "first, inactive state," "second, active state," and "intermediate state" are contemplated as being relative terms and may indicate a level of wearer activity along a spectrum.

For example, a "first, inactive state" may mean that the wearer is active but that the activity is less than the wearer's activity in the intermediate or second, active state. In another example, one part of the wearer may be active such as the wearer's legs when using a treadmill, but another part of the wearer may be inactive such as the wearer's arms when holding on to a guard rail of the treadmill. In this example, a motion-activated venting system located on, for example, a sleeve covering the wearer's arm may be in an inactive state while a motion-activated venting system located on, for example, leg portions of a short or pant may be in an active state.

Additionally, by configuring the motion-activated venting system as described, the plurality of apertures is exposed to provide ventilation when the wearer of the article of apparel is in motion, but the plurality of apertures is unexposed or covered when the wearer of the article of apparel is stationary. For example, when the wearer of the article of apparel is stationary, the motion-activated venting system is effectively closed. Continuing with this example, when the wearer of the article of apparel begins jogging, the motion-activated venting system dynamically changes to the intermediate state. As a result, the motion-activated venting system is opened to a degree greater than the motion-activated venting system in the first state to provide a first level of ventilation. Further, in this example, when the wearer of the article of apparel begins sprinting, the motion-activated venting system dynamically changes to the second state to provide an even greater level of ventilation. Consequently, the motion-activated venting system is opened to a degree greater than the motion-activated venting system in the first state and/or the intermediate state. Further, the motion-activated venting system may continually transition between the states described herein. This dynamic transition results in the motion-activated venting system repeatedly transitioning between an open, partially-open, and a closed state. As a result, pressure differentials are created, thereby driving airflow through the apertures of the motion-activated venting system.

The article of apparel may further comprise a motion-activated venting system in the article of apparel structured as one or more pleats or pleat structures. In some aspects, the one or more pleats may include a box pleat. The box pleat may comprise a first fold and a second fold opposite to the first fold. The box pleat may further comprise a ventilation region interposed between the first fold and the second fold, the ventilation region being comprised of a plurality of apertures and/or a mesh material. The plurality of apertures is substantially unexposed or covered when the box pleat is in a first, inactive state. In the intermediate state, a first portion of the plurality of apertures is covered and a second portion of the plurality of apertures is uncovered providing a first level of ventilation. Further, when the box pleat is in a second, active state, the plurality of apertures is substantially exposed or uncovered, thereby providing a second level of ventilation to the wearer where the second level of ventilation is greater than the first level of ventilation.

In additional aspects, the one or more pleat structures may include an accordion pleat. The accordion pleat may comprise a panel of material that is configured to have a plurality of folds that lie adjacent to one another. The folded panel is additionally configured to have a number of apertures forming the ventilation region. Because of the accordion structure, when the accordion pleat is in the first, inactive state, the folds lie adjacent to each other such that the plurality of apertures is substantially covered. Accordingly, when the accordion pleat in the second state, the pleat is expanded (i.e., the folds move away from one another), thereby exposing the plurality of apertures to provide enhanced ventilation.

It should be appreciated that when multiple pleat structures are located within the same article of apparel, at a specific point in time, each of the pleat structures may be in a different state. For example, depending on the activity that a wearer is engaged in, a box pleat located at a back portion of an article of apparel may be in a first, inactive state, while an accordion pleat located at an armpit portion of the article of apparel may be in the second, active state, while a third pleat structure located at yet a different portion of the article of apparel may be in an intermediate state. Any and all such aspects, and any variation thereof, are contemplated as being within the scope herein.

In additional aspects, the one or more pleats may comprise one or more knife pleat structures. The knife pleat may comprise a first fold terminating in a first folded edge and a ventilation region. The ventilation region may comprise a plurality of apertures and/or a mesh material. In some aspects, when the knife pleat is in the first, inactive state, the ventilation region is covered by the first fold. In the intermediate state, the ventilation region may be only partially covered by the first fold, and when the knife pleat is in the second, active state, the plurality of apertures may be substantially exposed. The knife pleat thereby provides a gradient of ventilation to a wearer of an article of apparel by gradually exposing the plurality of apertures when the knife pleat transitions from the first, inactive state to the intermediate state to the second, active state.

In another exemplary aspect, the motion-activated venting system may include one or more motion-activated vent inserts for incorporation into an article of apparel. Each of the motion-activated vent inserts may have any of the pleats described herein incorporated therein. By configuring the insert as described, the dynamic ventilation properties of the various pleats described herein are imparted to the article of apparel in the area at which the insert is incorporated.

A method of manufacturing an article of apparel having a motion-activated venting system is also described herein. The method may comprise providing at least a first panel of material; creating a plurality of apertures in at least a portion of the first panel to form a ventilation region; and forming at least a first folded edge in the first panel of material such that the first folded edge overlays the plurality of apertures in a first, inactive state. The method of manufacturing the article of apparel may further comprise forming the plurality of apertures using one or more of a laser, a knife, a die cut, a hot knife, and/or die cutting.

In exemplary aspects, the various pleats and motion-activated venting systems described herein may be oriented in a variety of directions. As used herein, orientational terminology, such as "vertically oriented," "horizontally oriented," and "diagonally oriented" refer to the orientation of the motion-activated venting systems and pleats in relation to the body of a wearer when the article of apparel is in an as-worn position. For example, a pleat in a shirt that is vertically oriented has an orientation that is generally parallel to the spine of the wearer. Accordingly, in one aspect, the motion-activated venting system may be vertically oriented. In another aspect, the motion-activated venting system may be horizontally oriented. Further, in some aspects the motion-activated venting system may be diagonally oriented.

Accordingly, the orientation of the pleats and motion-activated venting systems described herein may be modified to provide greater ventilation at regions of an article of apparel corresponding to regions of the body of a wearer that produce or retain excess body heat. Moreover, the orientation of the pleats may be optimized to take advantage of tension or stretching forces likely to occur at that particular location on the article of apparel. Further, the orientation of the pleats may be optimized to utilize gravity to least partially drive closure of the pleats. Thus, in some aspects, the pleats may be positioned vertically, or approximately vertical, or may be within a range of angles from vertical (e.g. less than 45, 30, 20, 10, or 5 degrees from vertical-depending on the desired closure properties), when the wearer is not in motion. As such, gravity may, at least in part, cause a pleat to be in a closed position.

Continuing, the various pleats and motion-activated venting systems described herein may be incorporated into any of a number of different apparel items. Exemplary apparel items may comprise, for example, shirts, skirts, pants, capris, half-pants, three-quarter pants, jackets, tank tops, sweatshirts, and the like. Moreover, the various pleat structures and motion-activated venting systems described herein may be located at any of a number of locations on the exemplary articles of apparel. For example, venting systems associated with an article of apparel for an upper torso of a wearer may be located on the front of the article, the back of the article, a sleeve portion of the article, an underarm portion of the article, and the like. Venting systems associated with an article of apparel for a lower torso of a wearer may be located on the front of the article, the back of the article, at the knee area, the back thigh area, and the like. Any and all aspects, and any variation thereof, are contemplated as being within the scope herein.

In some aspects, multiple combinations of the different aspects described herein may be combined within an article of apparel to achieve the desired ventilation properties. For example, the motion-activated venting systems described herein may be selected for incorporation at areas of the article of apparel to achieve a desired threshold amount of airflow at a region of the wearer's body when the wearer is in an active state. Accordingly, the location and number of the pleat structures described herein may be modified to be suitable for any article of apparel. For example, a box pleat may be located at one portion of an article of apparel, while an accordion pleat may be located at a separate portion of the same article of apparel.

Moreover, the size of the apertures and the sum total number of apertures associated with the pleat structures may further impart a desired threshold amount of airflow to the wearer's body. There may be a gradient in aperture size, such that the diameters or sizes of the apertures are larger at one region than another. For example, the diameters may decrease near the edges of the ventilation region, or the sizes of the apertures may be larger at portions of the ventilation region that correspond to locations of the body that generate a greater amount of heat or sweat. The result is an apparel item that provides customized ventilation to different areas of a wearer.

In some aspects, the concentration of apertures may be higher in some locations than others. For example, there may be a greater concentration of apertures at the upper portion of a pleat structure, wherein the apertures gradually decrease in concentration to the bottom of the pleat structure. Additionally, in some aspects, the apertures and/or ventilation region may extend beyond a pleat to at least a portion of the article of apparel. This can be advantageous because the higher concentration of apertures may be located at an area corresponding to a portion of the body of a wearer that produces or retains a high level of body heat.

In aspects described herein, the motion-activated venting system and the article of apparel may be formed from a plurality of different woven or knit materials having varying breathability, moisture-wicking, and/or ventilation properties. For instance, the ventilation region having the plurality of apertures may be formed from a material that is different from the material used to form the folds and/or the rest of the apparel item. In other aspects, a knit or woven fabric may be engineered with the apertures therein and then folded to create a pleat, such that an entire panel of the article of apparel is made from a unitary piece of fabric. In other aspects, a mesh may be used to achieve the desired ventilation in a pleat, in place of or in conjunction with the apertures described herein. Any and all such aspects, and any variation thereof, are contemplated as being within the scope herein.

In exemplary aspects, an aperture may be an opening that is formed through the entire thickness of a material utilizing one or more manufacturing processes. For example, an aperture may be formed with a laser, knife, die cut, hot knife, punch, and the like. It is also contemplated that an aperture may be integrally formed as part of the materials used to create the articles of apparel and the motion-activated venting systems. For example, knitting and/or weaving techniques may be utilized to integrally form an aperture within (and through) the surface of a material. For example, the apertures may be formed in a Jacquard or Dobby weave. Additionally, the apertures may be a variety of shapes, for example, squares, circles, rectangles, triangles, polygons, slits, or any other suitable shape. Any and all such aspects, and any variation thereof, are contemplated as being within the scope herein.

Additionally, the apertures may be reinforced to provide enhanced durability. For example, a perimeter of the apertures may be reinforced using resilient structural materials or substances like silicone or polyurethane. By way of further example, the apertures may be reinforced using stitching, grommets, or any other suitable structure around the apertures. In other aspects, a heat transfer material may be applied to a fabric and then cut (e.g., laser cut) to seal the edges of the aperture. Reinforcing the apertures in this way reduces fraying and provides structural support around the aperture. This may be particularly beneficial with woven or knit fabrics to reduce fraying, or in light-weight fabrics to increase support around the apertures and keep them open. Further, the reinforcement material may also be reflective or have a different color than the fabric, so that visual effects are achieved when the vents open and close during motion. In this way, visibility of the wearer can be increased when the wearer is in motion. The reflective and/or different colors may also be implemented in other areas of the article of apparel, such as the entire ventilation region. Any and all such aspects, and any variation thereof, are contemplated as being within the scope herein.

FIG. 1 illustrates a front view of an article of apparel 100 in an as-worn state, where the article of apparel 100 comprises an exemplary motion-activated venting system in the form of one or more box pleats 101 in a first, inactive state in accordance with an aspect herein. The article of apparel 100 may comprise a shirt or top, a jacket or coat, a pullover, a tank top, and the like. As mentioned hereinabove, the various pleat structures and vents provided herein may be located within the article of apparel at any number of desired locations. For example, as depicted here, the motion-activated venting system may include pleat structures at locations corresponding to the chest region and medial and lateral sides of the trunk of the wearer.

Each box pleat 101 may comprise a first fold 102 and a second fold 104 opposite to the first fold 102. The first fold 102 terminates in a first folded edge 106 and the second fold 104 terminates in a second folded edge 108 opposite to the first edge 106. A ventilation region 110 is interposed between the first fold 102 and the second fold 104 (shown more clearly in FIG. 2). Further, the ventilation region 110 has a plurality of apertures (shown more clearly in FIG. 2 as element 112). As shown in FIG. 1, the plurality of apertures are covered or substantially covered by the first fold 102 and the second fold 104 when the box pleat 101 is in a first, inactive state. Additionally, as shown in FIG. 1, the first edge 106 and the second edge 108 are proximate, adjacent to, or substantially adjacent to one another when the box pleat 101 is in a first, inactive state. When the article of apparel 100 is in an as-worn configuration, the ventilation region 110 may be adjacent to or proximate to the skin of the wearer (or adjacent to one or more base layers worn by the wearer) and the folds 102 and 104 may be situated on an external-facing surface of the article of apparel 100.

Figure 2:
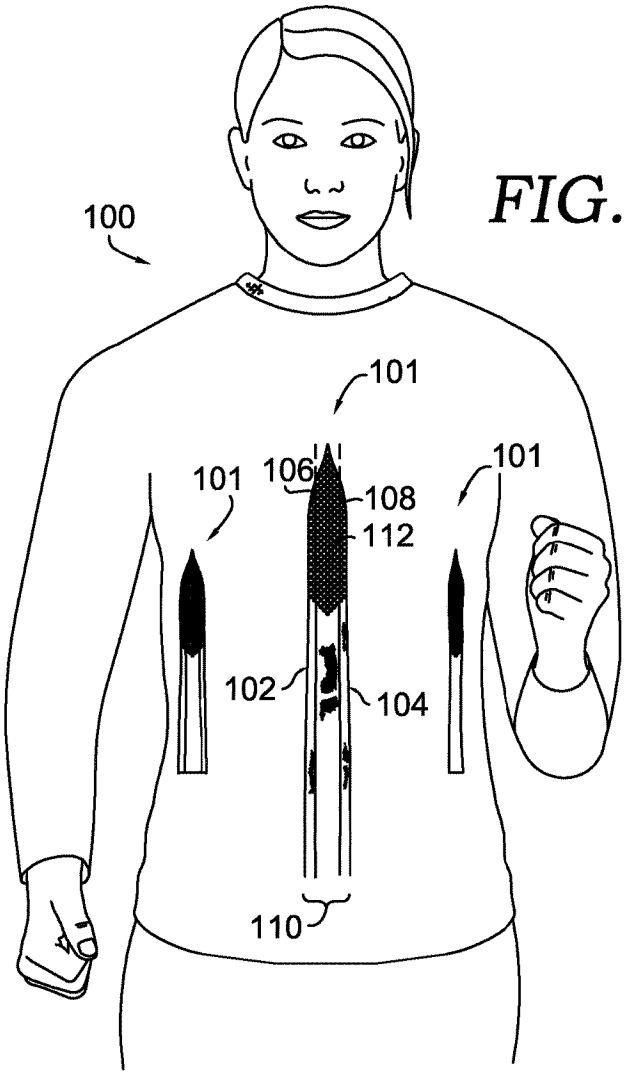
FIG. 2 illustrates the front view of the article of apparel of FIG. 1, where the exemplary motion-activated venting system comprises the one or more box pleats in a second, active state in accordance with an aspect herein.

FIG. 2 illustrates the front view of the article of apparel 100 of FIG. 1, where the exemplary motion-activated venting system comprises the one or more box pleats 101 in a second, active state in accordance with an aspect herein. As shown in FIG. 2, the first edge 106 and the second edge 108 are remote one another, such that the plurality of apertures 112 is exposed. The movement of the first and second edges 106 and 108 away from the ventilation region 110 may occur in response to, for example, wearer movement. In particular, the movement of the wearer's arms may cause the edges 106 and 108 to be "pulled away" from the ventilation region 110, thereby exposing the apertures 112. Accordingly, in the second state, the one or more box pleats 101 may act as inflow vents or intake valves that facilitate movement of air through the article of apparel 100. Typical movements that may cause this include running, throwing, bicycling, and the like. Further, the movements of the wearer may cause repeated and continuous movement of the box pleat 101 between the first, inactive state and the second, active state. As a result, the box pleat 101, and other pleat structures described herein, may effectively pump air through the article of apparel 100, similar to a bellows.

Accordingly, when the motion-activated venting system is in the second, active state, a greater portion of the ventilation region 110 and the plurality of apertures 112 are exposed, as compared to the portion of the ventilation region 110 and the plurality of apertures 112 exposed when the motion-activated venting system is in the first, inactive state shown in FIG. 1.

Figure 3:
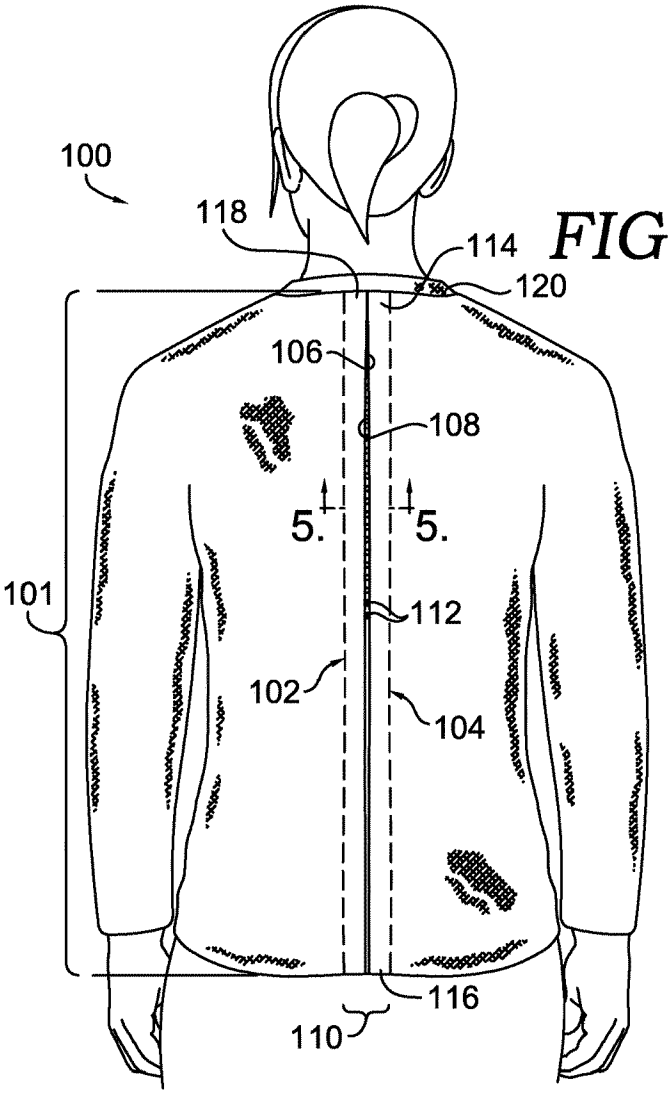
FIG. 3 illustrates a back view of an article of apparel in an as-worn state, where the article of apparel comprises an exemplary motion-activated venting system in the form of a box pleat in a first, inactive state in accordance with an aspect herein.

FIG. 3 illustrates a back view of the article of apparel 100 of FIGS. 1 and 2, in an as-worn state, and in a first, inactive state in accordance with an aspect herein. The article of apparel 100 may include a box pleat 101, similar to the box pleats 101 described above. Further, the box pleat 101 depicted here may, in some aspects, be implemented with other pleats or venting structures as part of the motion-activated venting system. For instance, the box pleat 101 may be incorporated in a back panel of a shirt, adapted to cover a back torso of a wearer, opposite the one or more box pleats 101 depicted in FIGS. 1 and 2. As discussed in more detail above, the box pleat 101 may comprise a first fold 102, a second fold 104 opposite to the first fold 102, a first folded edge 106, and a second folded edge 108 opposite to the first edge 106. A ventilation region 110 having a plurality of apertures 112 is interposed between the first fold 102 and the second fold 104 (shown more clearly in FIG. 4). The box pleat 101 may additionally comprise an upper portion 114 and a lower portion 116. In some aspects, as shown in FIG. 3, the upper portion 114 may be adjacent to or abut a collar 120. Although a collar is shown in FIG. 3, it is contemplated herein that the upper portion 114 may be adjacent to a yoke structure. In some aspects, the first folded edge 106 and the second folded edge 108 are secured to the article of apparel 100 at the upper portion 114. The remainder of the folded edges 106 and 108, however, may remain unaffixed from the article of apparel 100 such that they are freely movable in response to, for example, wearer movement, wind, and the like.

Figure 4:
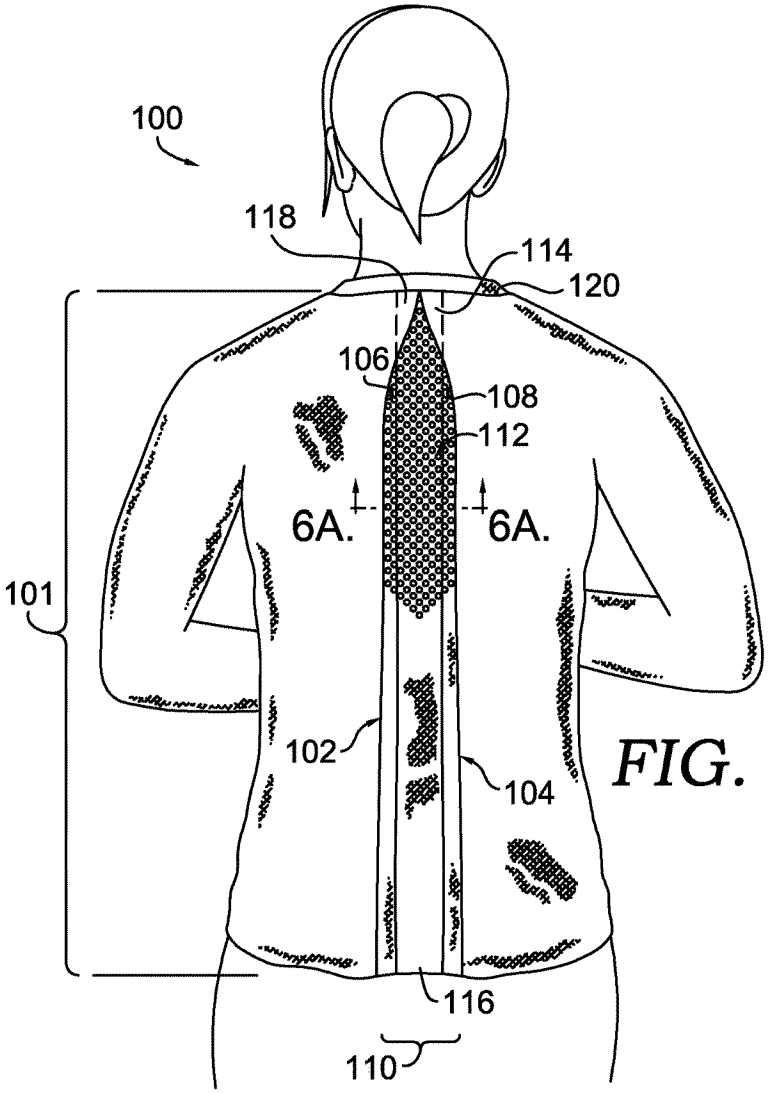
FIG. 4 illustrates the back view of the article of apparel of FIG. 3, where the exemplary motion-activated venting system comprises the box pleat in a second, active state in accordance with an aspect herein.

FIG. 4 illustrates the back view of the article of apparel 100 of FIG. 3, where the exemplary motion-activated venting system is in a second, active state in accordance with an aspect herein. As shown in FIG. 4, the first edge 106 and the second edge 108 are remote one another, such that the plurality of apertures 112 is exposed. As discussed with reference to FIG. 2, the movement of the first and second edges 106 and 108 away from the ventilation region 110 may occur in response to, for example, wearer movement. When the motion-activated venting system is in the second, active state, a greater portion of the ventilation region 110 and the plurality of apertures 112 are exposed, as compared to the portion of the ventilation region 110 and the plurality of apertures 112 exposed when the motion-activated venting system is in the first, inactive state shown in FIG. 3. Further, the space between the first edge 106 and the second edge 108 may be greater at the lower portion 116 of the box pleat 101 than at the upper portion 114 of the box pleat 101 due to the construction of the box pleat 101. Further, airflow created by the one or more box pleats 101 depicted in FIG. 2, may travel from the torso of the wearer toward the back of the wearer, thereby urging the first and second edges 106 and 108 away from the ventilation region 110. As a result, the box pleat 101 depicted here may act as an outflow vent or exhaust valve.

Figure 5:
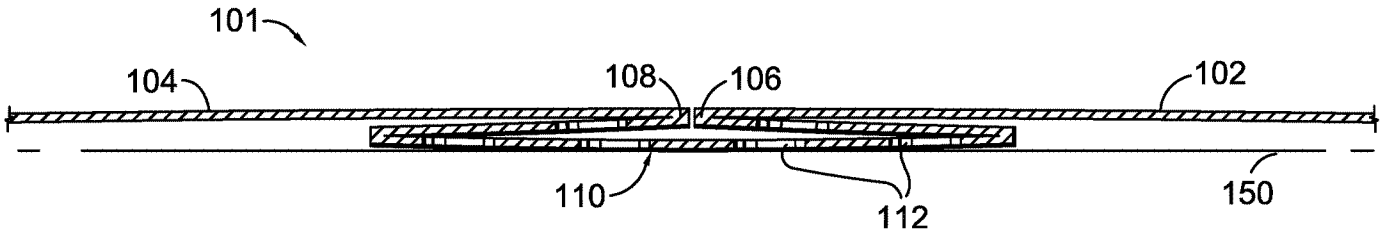
FIG. 5 illustrates a top-down cross-sectional view of the box pleat of the exemplary motion-activated venting system shown in FIG. 3, where the exemplary motion-activated venting system is in the first, inactive state in accordance with an aspect herein.

FIG. 5 illustrates a top-down cross-sectional view of a box pleat 101 of the exemplary motion-activated venting system shown in FIGS. 1 and 3, in the first, inactive state in accordance with an aspect herein. As shown in FIG. 5, when the box pleat 101 is in the first, inactive state, the ventilation region 110 having the plurality of apertures 112 is in a collapsed or folded state. In other words, the ventilation region 110 is folded onto itself. The box pleat 101 comprises the first fold 102 and the second fold 104 opposite to the first fold 102. The first fold 102 terminates in the first edge 106 and the second fold 104 terminates in the second edge 108. The box pleat 101 further comprises the ventilation region 110 having the plurality of apertures 112. As can be seen in FIG. 5, at least a portion of the first fold 102 overlies, is adjacent to, or is proximate the ventilation region 110, when the box pleat 101 is in the first, inactive state. As well, at least a portion of the second fold 104 overlies, is adjacent to, or is proximate the ventilation region 110, when the box pleat 101 is in the first, inactive state. Consequently, the plurality of apertures 112 of the ventilation region 110 is unexposed, or substantially unexposed, when the box pleat 101 is in the first, inactive state. Further, when the box pleat 101 is in the first, inactive state, the first fold 102 and second fold 104 are adjacent or proximate to a baseline surface 150, which may be, for example, the skin of the wearer or one or more base layers worn by the wearer.

Figure 6A:
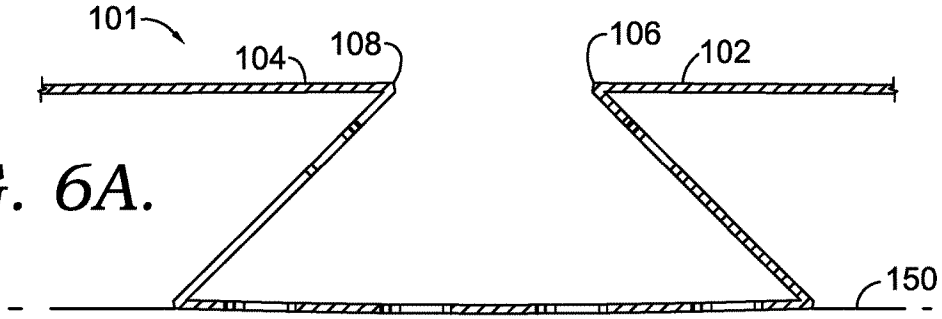
FIG. 6A illustrates a top-down cross-sectional view of the box pleat aspect of the exemplary motion-activated venting system shown in FIGS. 3 and 4, where the exemplary motion-activated venting system is an intermediate state in accordance with an aspect herein.

FIG. 6A illustrates a top-down cross-sectional view of a box pleat aspect of the exemplary motion-activated venting system shown in FIGS. 1-4, where the exemplary motion-activated venting system is an intermediate state in accordance with an aspect herein. As shown in FIG. 6A, when the box pleat 101 is in the intermediate state, the first edge 106 and the second edge 108 are more remote from one another, as compared to the first edge 106 and second edge 108 of the box pleat 101 when the box pleat 101 is in the first, inactive state, as shown in FIG. 5. As such, when the box pleat 101 is in the intermediate state, the ventilation region 110 is partially expanded due to the first edge 106 and the second edge 108 moving away from each other. As a result, a portion of the plurality of apertures 112 is exposed, thereby providing an intermediate level of ventilation. Additionally, the first fold 102 and second fold 104 of the box pleat 101 (and the other pleat structures provided herein) are further away from the baseline surface 150, as compared to the position shown in the first, inactive state, as shown in FIG. 5. Accordingly, the box pleat 101 stands-off from the baseline surface 150.

Figure 6B:
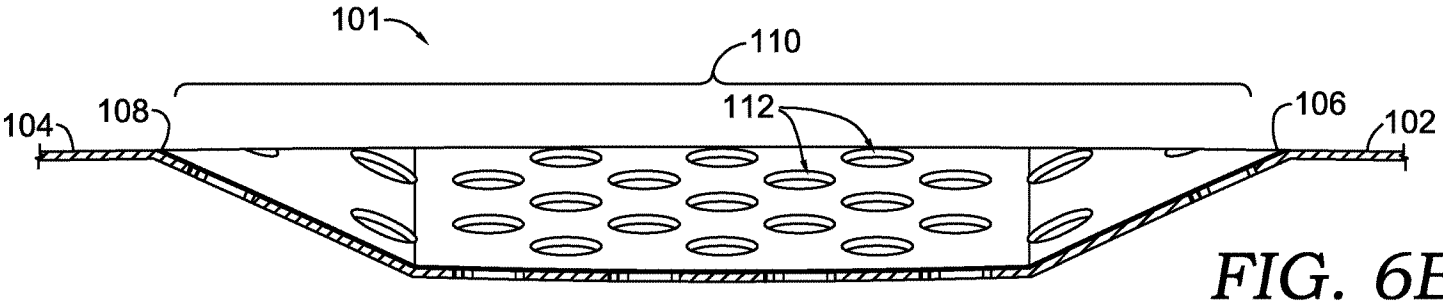
FIG. 6B illustrates a perspective top-down cross-sectional view of the box pleat aspect of the exemplary motion-activated venting system shown in FIG. 4, where the exemplary motion-activated venting system is in the second, active state in accordance with an aspect herein.

FIG. 6B illustrates a perspective top-down cross-sectional view of the box pleat 101 of the exemplary motion-activated venting system shown in FIGS. 2 and 4, where the exemplary motion-activated venting system is in the second, active state in accordance with an aspect herein. FIG. 6B depicts the box pleat 101 at perspective to show the plurality of apertures 112. As shown in FIG. 6B, when the box pleat 101 is in the second, active state, the first edge 106 and the second edge 108 are even more remote from one another, as compared to the first edge 106 and second edge 108 of the box pleat 101 when the box pleat 101 is in the first, inactive state, as shown in FIG. 3. Further, when the box pleat 101 is in the second, active state, the first edge 106 and the second edge 108 are more remote from one another, as compared to the first edge 106 and second edge 108 of the box pleat 101 when the box pleat 101 is in the intermediate state, as shown in FIG. 6A. As such, when the box pleat 101 is in the second, active state, the ventilation region 110 is expanded due to the first edge 106 and the second edge 108 moving away from each other. In other words, in the second, active state the ventilation region 110 is no longer folded onto itself. As a result, a greater number of the plurality of apertures 112 is exposed, thereby providing ventilation.

Figure 7:
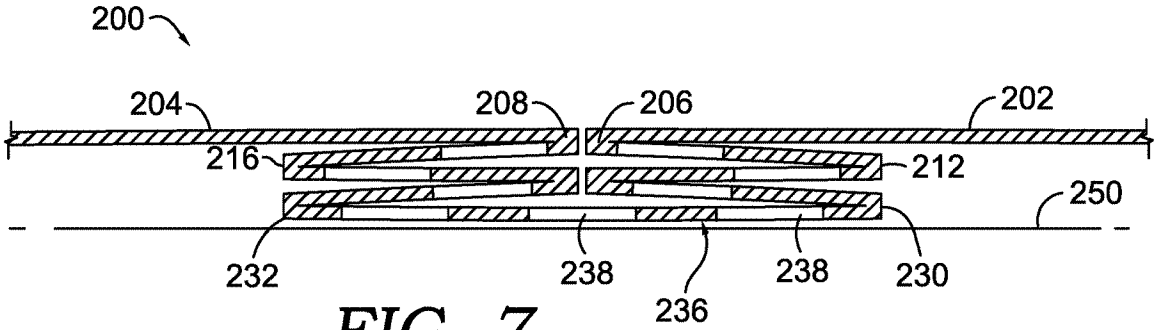
FIG. 7 illustrates a top-down cross-sectional view of a double box pleat of an exemplary motion-activated venting system in a first, inactive state in accordance with an aspect herein.

FIG. 7 illustrates a top-down cross-sectional view of a double box pleat 200 aspect of a venting system in a first, inactive state in accordance with an aspect herein. In aspects herein, the double box pleat 200 is an alternative configuration of the box pleat 101. The double box pleat 200 may comprise a first fold 202 and a second fold 204 opposite to the first fold 202. The first fold 202 terminates in a first edge 206 and the second fold 204 terminates in a second edge 208 opposite to the first edge 206. The double box pleat 200 further comprises a ventilation region 236, the ventilation region 236 having a plurality of apertures 238. The double box pleat 200 may be formed by folding the ventilation region 236 onto itself more than once. As such, the double box pleat 200 may further comprise a first crease 212, a second crease 216, a third crease 230 and a fourth crease 232. Additional creases are contemplated herein.

As shown in FIG. 7, when the double box pleat 200 is in a first, inactive state, the first edge 206 is adjacent to or proximate the second edge 208, such that the plurality of apertures 238 is covered or substantially covered by the first fold 202, the second fold 204, and the creases 212, 216, 230, and 232. Accordingly, the double box pleat 200 is collapsed or closed when the double box pleat 200 is in a first, inactive state. Further, when the double box pleat 200 is in the first, inactive state, the first fold 202 and second fold 204 are adjacent or proximate to a baseline surface 250.

Figure 8:
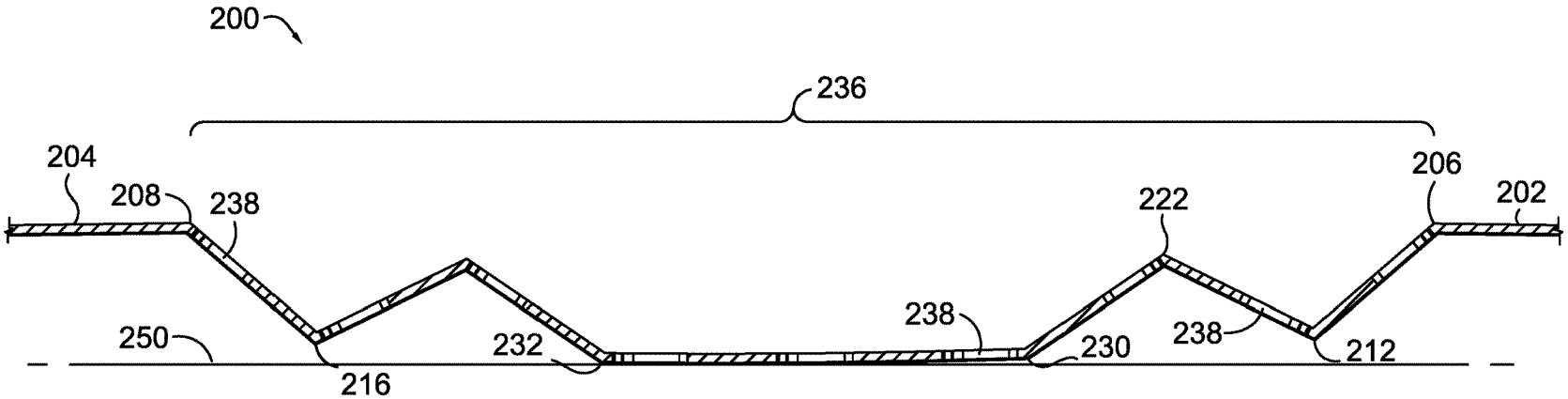
FIG. 8 illustrates a top down cross-sectional view of the double box pleat of the exemplary motion-activated venting system according to FIG. 7, where the exemplary motion-activated venting system is in a second, active state in accordance with an aspect herein.

FIG. 8 illustrates a top-down cross-sectional view of the double box pleat 200 of the venting system according to FIG. 7, in a second, active state in accordance with an aspect herein. As shown in FIG. 8, when the double box pleat 200 is in the second, active state, the first edge 206 and the second edge 208 are more remote one another, as compared to the first edge 206 and the second edge 208 of the double box pleat 200 when the double box pleat 200 in the first, inactive state, as shown in FIG. 7. As such, the first crease 212, the second crease 216, the third crease 230 and the fourth crease 232 are expanded or opened when the double box pleat 200 is in the second, active state. As a result, when the double box pleat 200 is in the second, active state, the plurality of apertures 238 is uncovered or substantially uncovered by the first fold 202 and the second fold 204. As a result, when the double box pleat 200 is in the second, active state, a larger surface area of the ventilation region 236 is exposed, as compared to the surface area of the ventilation region 236 exposed when the double box pleat 200 is in the first, inactive state. Thereby, a greater number of the plurality of apertures 238 is exposed, as compared to the number of the plurality of apertures 238 exposed when the double box pleat 200 is in the first, inactive state, thus providing enhanced ventilation. Additionally, the first fold 202 and second fold 204 of the double box pleat 200 (and the other pleat structures provided herein) are further away from the baseline surface 250, as compared to the position shown in the first, inactive state. It is contemplated herein that the double box pleat 200 may further be in an intermediate state as described above.

Figure 9:
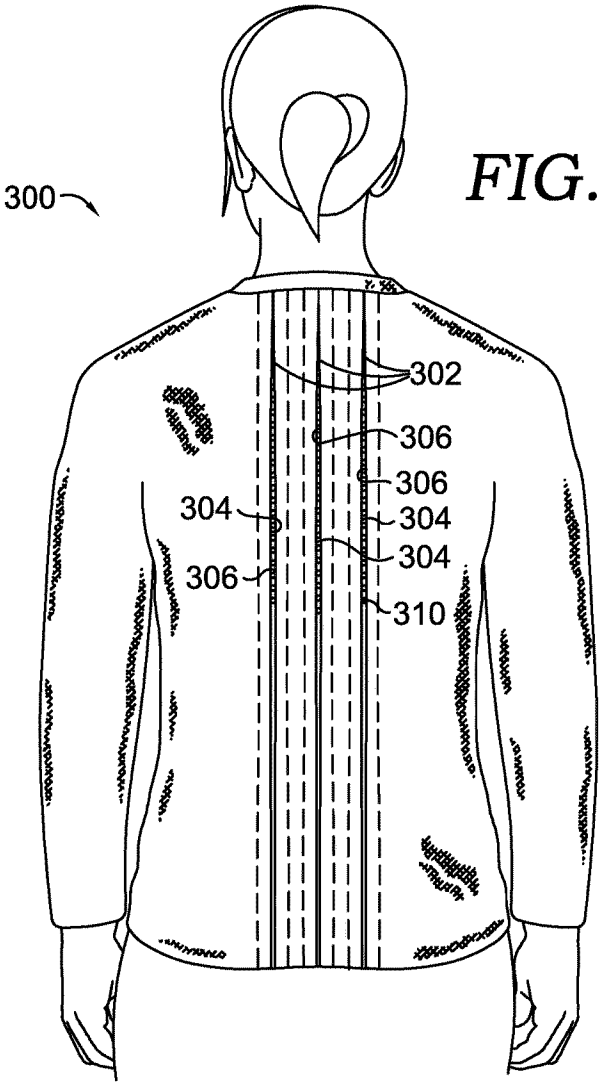
FIG. 9 illustrates a back view of an article of apparel in an as-worn state, where the article of apparel comprises an exemplary motion-activated venting system in the form of a plurality of box pleats in a first, inactive state in accordance with an aspect herein.

FIG. 9 illustrates a back view of an exemplary article of apparel 300 in an as-worn state, where the article of apparel 300 comprises an exemplary motion-activated venting system in the form of a plurality of box pleats 302 in a first, inactive state in accordance with an aspect herein. As mentioned above, multiple combinations of the different aspects described herein may be combined within an article of apparel 300 to achieve desired ventilation properties. This allows desired ventilation properties to be imparted within the article of apparel 300 at desired locations. Additionally, the size of the pleats described herein may vary according to their intended use. FIG. 9 shows one example of this concept. FIG. 9 shows three box pleats 302, described according to FIGS. 1 and 3, in a first, inactive state, incorporated into the article of apparel 300. In some aspects, each of the box pleats 302 is formed in the same panel of material. Accordingly, as shown in FIG. 9, the first edge 304 and the second edge 306 of each of the box pleats 302 are adjacent to or proximate one another when the box pleats 302 are in a first, inactive state. Moreover, each of the edges 304 and 306 overlie a ventilation region 308 having a plurality of apertures 310 (shown in FIG. 10).

Figure 10:
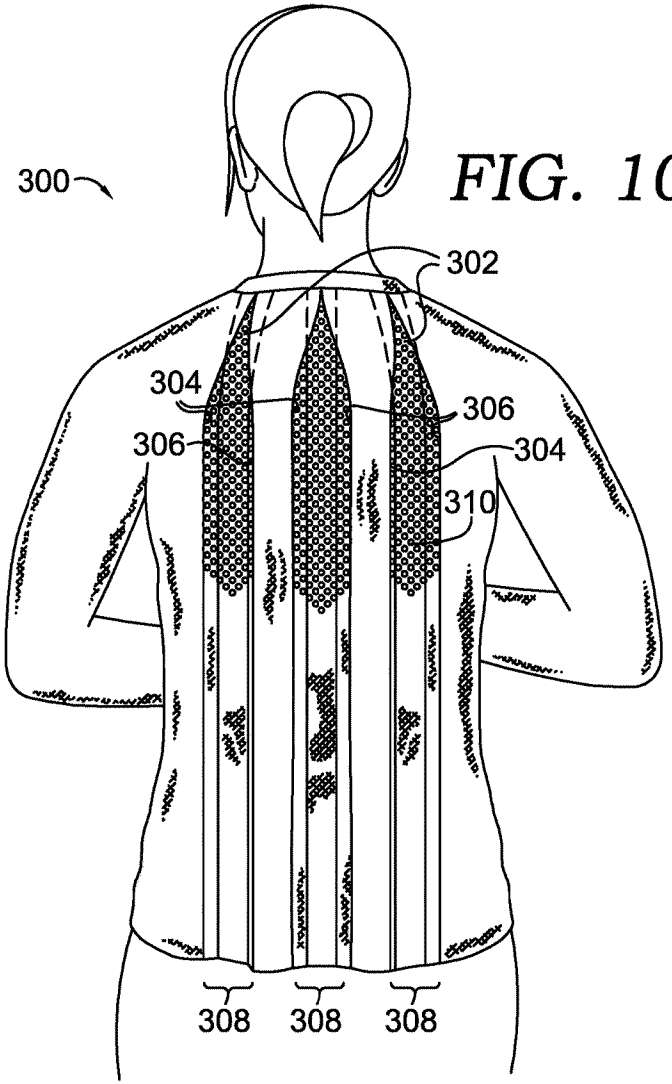
FIG. 10 illustrates the back view of the article of apparel of FIG. 9, where the exemplary motion-activated venting system is in a second, active state in accordance with an aspect herein.

FIG. 10 illustrates the back view of the article of apparel 300 of FIG. 9, where the exemplary motion-activated venting system is in a second, active state in accordance with an aspect herein. FIG. 10 shows the plurality of box pleats 302 in the second, active state. Accordingly, as described hereinabove with reference to FIGS. 2, 4, and 6, the first edge 304 and the second edge 306 of each of the plurality of box pleats 302 are remote from one another, or more remote one another as compared to the plurality of box pleats 302 shown in FIG. 9, in the first, inactive state. As a result, a greater number of the plurality of apertures 310 is exposed, thereby providing enhanced ventilation at multiple regions of the article of apparel 300. The plurality of box pleats 302 may also be in an intermediate state as described above.

Figure 11:
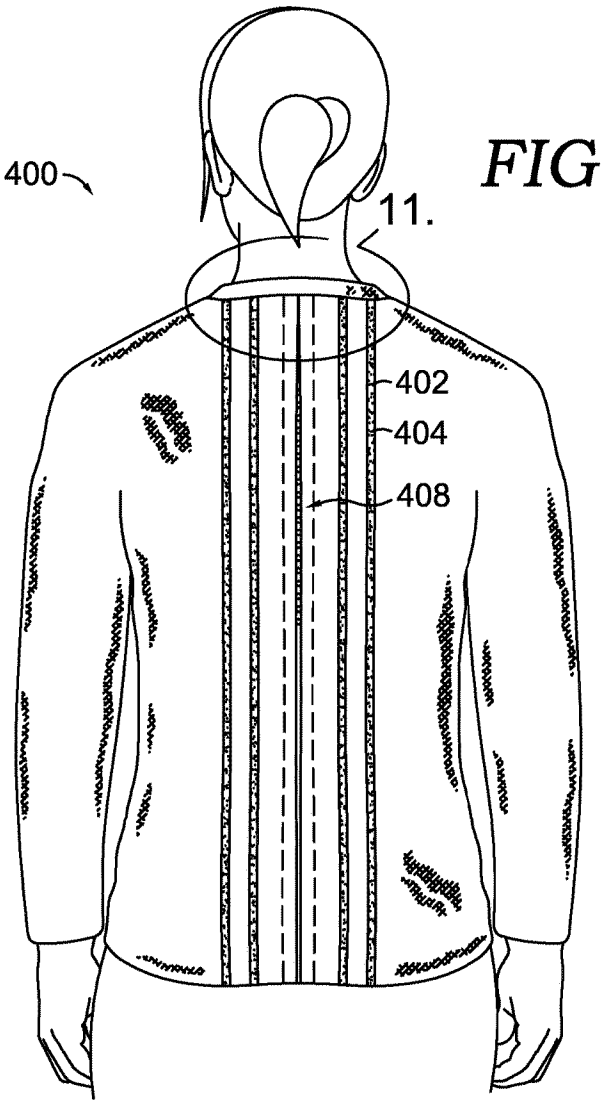
FIG. 11 illustrates a back view of an article of apparel an as-worn state, where the article of apparel comprises an exemplary motion-activated venting system in the form of a plurality of supplemental vents and a box pleat in a first, inactive state, in accordance with an aspect herein.

FIG. 11 illustrates a back view of an article of apparel 400 in an as-worn state, where the article of apparel 400 comprises an exemplary motion-activated venting system in the form of a plurality of supplemental vents 402 and a box pleat 408 in a first, inactive state, in accordance with an aspect herein. As shown in FIG. 11, the exemplary motion-activated venting system may comprise one or more supplemental vents 402, the supplemental vents 402 having a plurality of exposed apertures 404. In an alternative aspect, the supplemental vents 402 may comprise a mesh material. In this aspect, the supplemental vents 402 are affixed in a position that provides permanent exposure of the plurality of apertures 404. The location of the supplemental vents 402 is exemplary only, and it is contemplated herein that the plurality of supplemental vents 402 may be located at other positions on the article of apparel 400 such as the sleeves and/or the front portion of the article of apparel 400.

Figure 12:
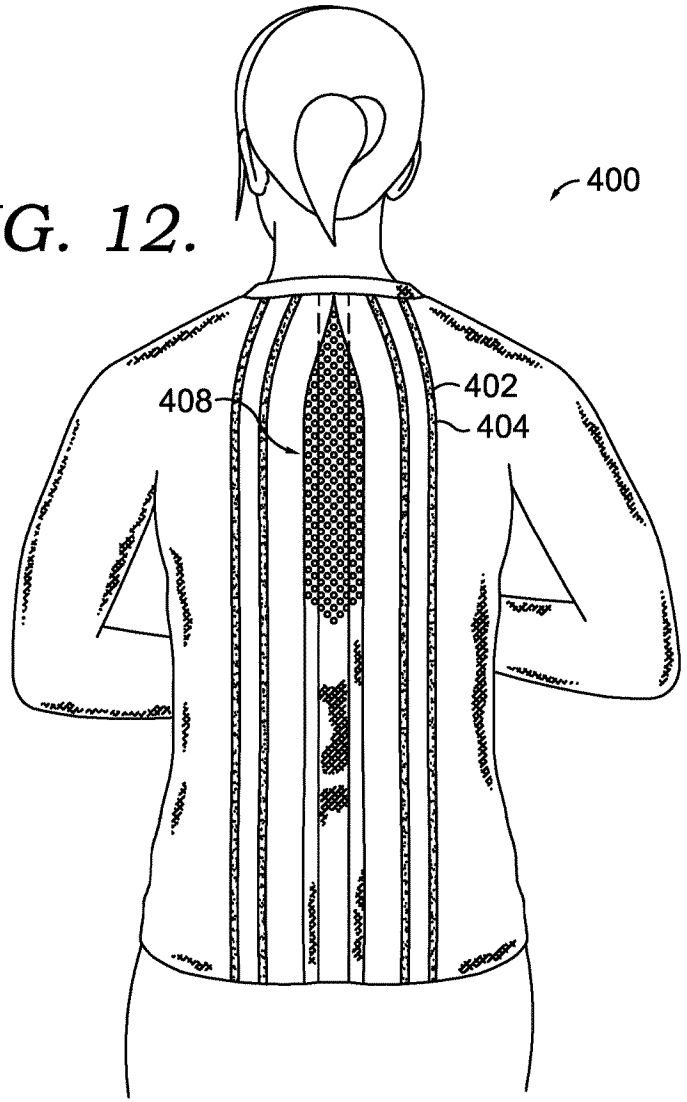
FIG. 12 illustrates the back view of the article of apparel of FIG. 11, where the exemplary motion-activated venting system is in a second, active state in accordance with an aspect herein.

FIG. 12 illustrates the back view of the article of apparel 400 of FIG. 11, where the exemplary motion-activated venting system is in a second, active state in accordance with an aspect herein. As can be seen in FIG. 12, the plurality of supplemental vents 402 remains in substantially the same configuration in the second, active state, as compared to the plurality of supplemental vents 402 in a first, inactive state. FIG. 12 further shows the box pleat 408 in the second, active state, according to aspects described hereinabove. By using the supplemental vents 402, a baseline level of ventilation may be achieved regardless of whether the wearer is active or inactive.

Figure 13:
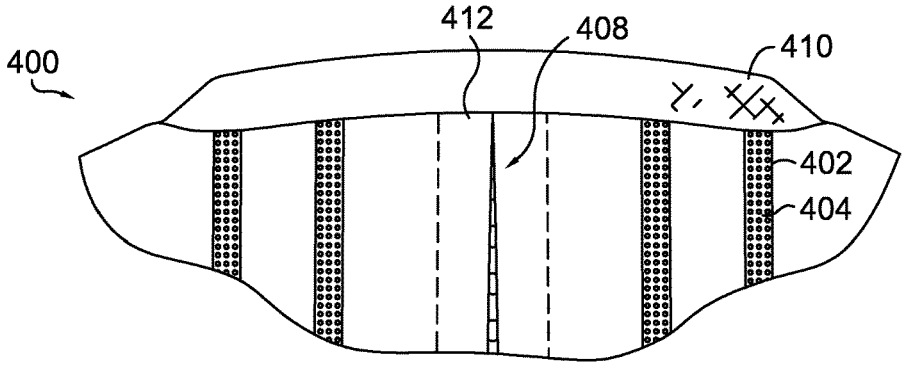
FIG. 13 illustrates a close-up view of a portion of the article of apparel of FIG. 11, where the upper portion of the exemplary motion-activated venting system is disposed adjacent to a yoke of a shirt in accordance with an aspect herein.

FIG. 13 illustrates a close-up view of a portion of the article of apparel 400 of FIG. 13, where the upper portion of the exemplary motion-activated venting system is disposed adjacent to a collar 410 of the article of apparel 400 in accordance with an aspect herein. As shown in FIG. 13, the plurality of supplemental vents 402 and the box pleat 408, or other pleats described herein, may be incorporated into an article of apparel, for example, a top. Continuing with this example the pleats described herein may be incorporated into a back panel of a top. Accordingly, FIG. 13 illustrates an upper portion of the box pleat 408 located adjacent to or abutting the collar 410. In some aspects, at least a terminal portion of the upper portion 412 of the box pleat 408 and the plurality of supplemental vents 402 are disposed beneath the collar 410, such that the collar 410 covers or helps to affix the terminal portion of the upper portion 412 of the box pleat 408 and the plurality of supplemental vents 402. Alternatively, the box pleat 408 and the plurality of supplemental vents 402 may terminate at or be affixed to the collar 410. The collar 410 may also refer to a yoke portion of a top of an article of apparel, or may be a panel of an article of apparel. As can be appreciated, the above are merely examples and various means transitioning the pleats described herein to portions of an article of apparel are considered within the scope of the present invention.

Figure 14:
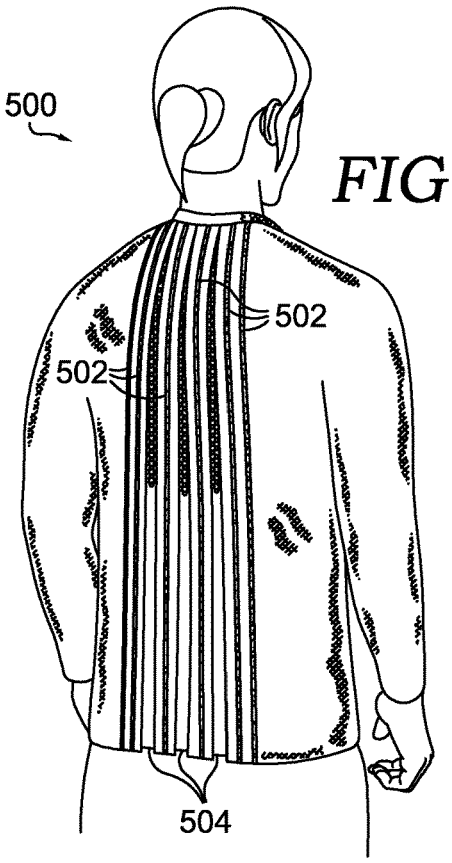
FIG. 14 illustrates a back perspective view of an article of apparel in an as-worn state, where the article of apparel comprises an exemplary motion-activated venting system in the form of plurality of supplemental vents and a plurality of pleats, in a first, inactive state in accordance with an aspect herein.
Figure 15:
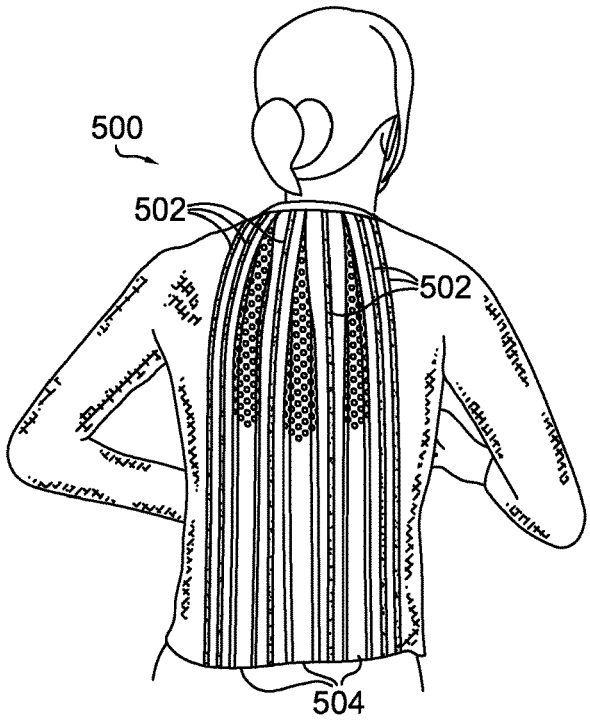
FIG. 15 illustrates the back perspective view of the article of apparel of FIG. 14, where the exemplary motion-activated venting system is in a second, active state in accordance with an aspect herein.

FIGS. 14 and 15 illustrate yet another exemplary configuration for the motion-activated venting system described herein. FIG. 14 illustrates a back perspective view of an article of apparel 500 in an as-worn state, where the article of apparel 500 comprises a plurality of supplemental vents 502 and a plurality of pleats 504, in a first, inactive state in accordance with an aspect herein. FIG. 15 illustrates the back perspective view of the article of apparel 500 of FIG. 14, where the supplemental vents 502 and the plurality of box pleats 504 are in a second, active state in accordance with an aspect herein.

Figure 16:
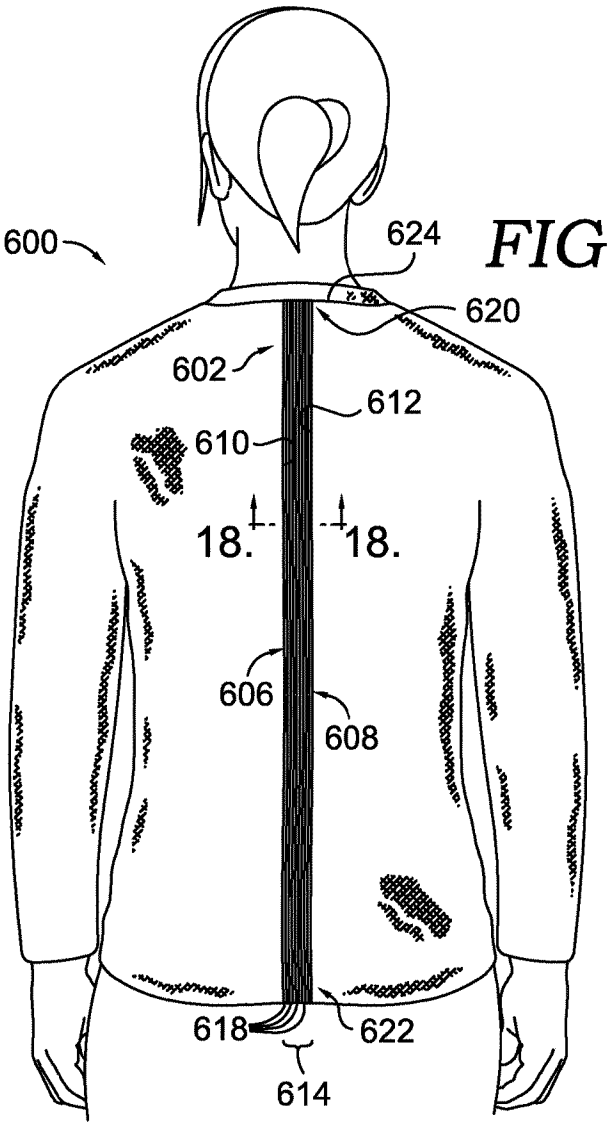
FIG. 16 illustrates a back view of an article of apparel in an as-worn state, where the article of apparel comprises an exemplary motion-activated venting system in the form of an accordion pleat in a first, inactive state in accordance with an aspect herein.

Continuing, FIG. 16 illustrates a back view of an article of apparel 600 in an as-worn state, where the article of apparel 600 comprises an exemplary motion-activated venting system in the form of an accordion pleat 602 in a first, inactive state in accordance with an aspect herein. The accordion pleat 602 may comprise a first fold 606 and a second fold 608 opposite to the first fold 606. The first fold 606 terminates in a first edge 610 and the second fold 608 terminates in a second edge 612 opposite to the first edge 610. Disposed between the first edge 610 and second edge 612 is a ventilation region 614 with a plurality of apertures (shown as element 616 in FIG. 17). The ventilation region 614 is folded a number of time to form a plurality of creases 618. The accordion pleat 602 further comprises an upper portion 620 and a lower portion 622. In aspects, each of the plurality of creases 618 may be affixed to a collar 624 at the upper portion 620 of the accordion pleat 602. Further, the creases 618 are free-floating or unaffixed at locations remote from the upper portion 620. Additionally, the plurality of creases 618 are adjacent, substantially adjacent, or proximate one another when the accordion pleat 602 is in the first, inactive state. Because of the accordion structure, when the accordion pleat 602 is in the first, inactive state, as shown in FIG. 16, the plurality of apertures are unexposed.

Figure 17:
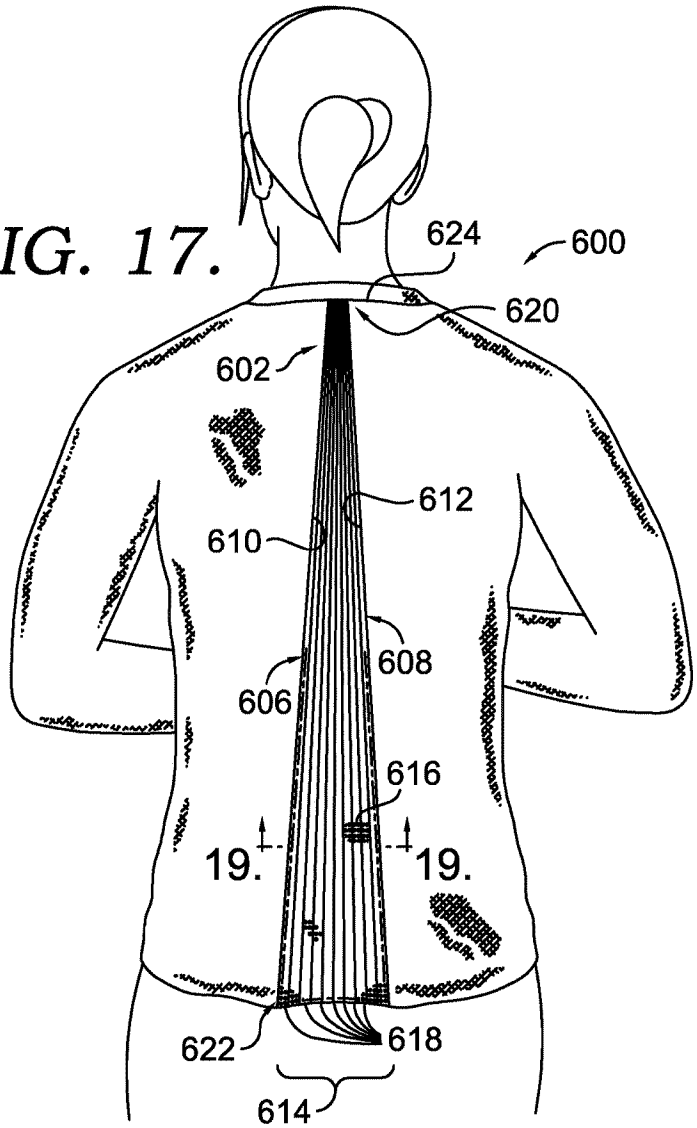
FIG. 17 illustrates the back view of the article of apparel of FIG. 16, where the exemplary motion-activated venting system is in a second, active state in accordance with an aspect herein.

FIG. 17 illustrates the back view of the article of apparel 600 of FIG. 16, where the exemplary motion-activated venting system is in a second, active state in accordance with an aspect herein. As shown in FIG. 17, in the second, active state, the first edge 610 and the second edge 612 of the accordion pleat 602 are more remote one another, as compared to the first edge 610 and the second edge 612 when the accordion pleat 602 in the first, inactive state. Further, as shown in FIG. 17, the first edge 610 and the second edge 612 of the accordion pleat 602 may be separated by a distance at the lower portion 622 that is greater than a distance at the upper portion 620, when the accordion pleat 602 is in the second, active state. As a result, when the accordion pleat 602 is in the second, active state, a greater number of the plurality of apertures 616 of the ventilation region 614 are exposed, as compared to the number of apertures exposed when the accordion pleat 602 is in the first, inactive state. Resultantly, enhanced ventilation is provided by exposing a greater number of the plurality of apertures 616 when the accordion pleat 602 is in the second, active state. It is further contemplated that the accordion pleat 602 may be in an intermediate state as described herein.

Figure 18:
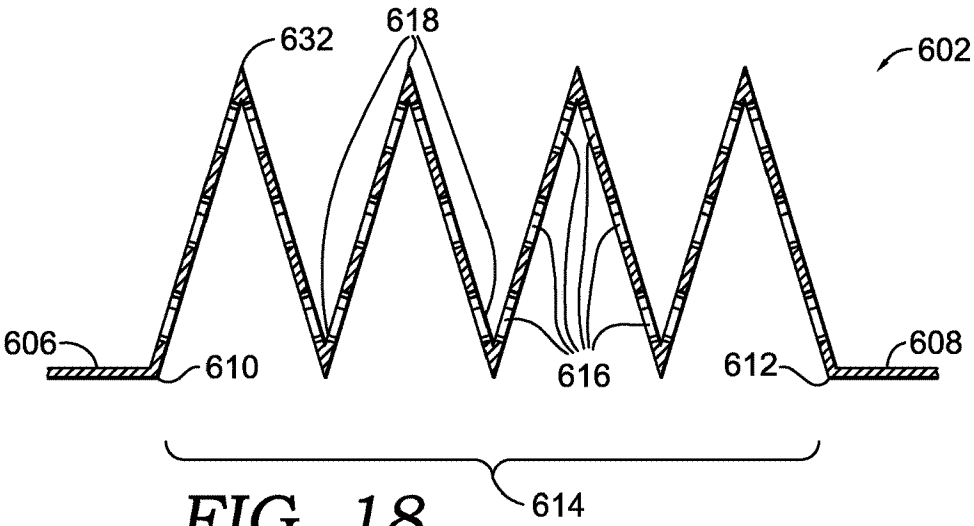
FIG. 18 illustrates a top-down cross-sectional view of the accordion pleat aspect of the exemplary motion-activated venting system shown in FIG. 16, where the exemplary motion-activated venting system is in the first, inactive state in accordance with an aspect herein.

FIG. 18 illustrates a top-down cross-sectional view of the accordion pleat 602 aspect of the exemplary motion-activated venting system shown in FIG. 16, in the first, inactive state in accordance with an aspect herein. As described, the accordion pleat 602 may comprise the first fold 606 and the second fold 608 opposite to the first fold 606. The first fold 606 terminates in the first edge 610 and the second fold 608 terminates in the second edge 612 opposite to the first edge 610. Disposed between the first edge 610 and second edge 612, there may be the ventilation region 614 with the plurality of apertures 616. In this aspect, the ventilation region 614 may be folded to create the plurality of creases 618. Each crease of the plurality of creases 618 terminates in a direction opposite to the immediately preceding crease. For example, a first crease 632 of the plurality of creases 618 may be located at an interior portion of the accordion pleat 602 and a second, subsequent crease may be located at an exterior portion of the accordion pleat 602. This pattern is repeated for each of the remaining creases of the plurality of creases 618, such that the creases 618 create an accordion structure. As shown in FIG. 18, each crease of the plurality of creases 618 is adjacent to, substantially adjacent to, or proximate the immediately preceding and subsequent crease, when the accordion pleat 602 is in a first, inactive state.

Although the pleat structure of the accordion pleat 602 according to FIG. 18 is described herein as having a first edge 610 and a second edge 612 located at an outer portion of the accordion pleat 602, it can be appreciated that other orientations are possible. Specifically, the first fold 606, the second fold 608, the first edge 610, and the second edge 612 may also be located at an inner portion of the accordion pleat 602.

Figure 19:
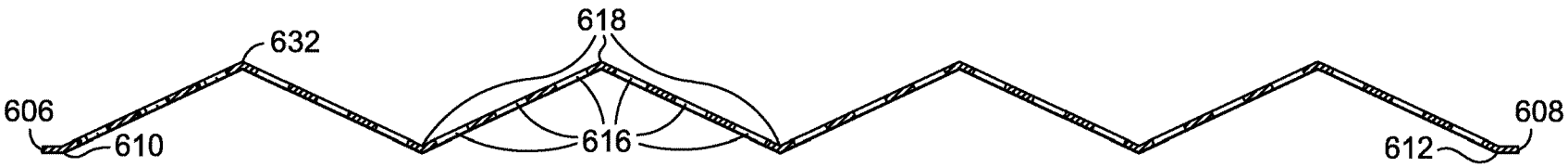
FIG. 19 illustrates a top-down cross-sectional view of the accordion pleat aspect of the exemplary motion-activated venting system shown in FIG. 18, where the exemplary motion-activated venting system is in the second, active state in accordance with an aspect herein.

FIG. 19 illustrates a top-down cross-sectional view of the accordion pleat 602 aspect of the motion-activated venting system shown in FIG. 17, in the second, active state in accordance with an aspect herein. As can be seen in FIG. 19, when the accordion pleat 602 is in a second, active state, the first crease 632 of the plurality of creases 618 has a relatively greater angular distance from the first fold 606 of the accordion pleat 602, as measured from the inner portion of the accordion pleat 602, as compared to the accordion pleat 602 in the first, inactive state. Additionally, as shown in FIG. 19, when the accordion pleat 602 is in the second, active state, the distance between each of the plurality of creases 618 is greater than the distance between each of the plurality of creases 618, as compared to the accordion pleat 602 in the first, inactive state, as shown in FIG. 18. As a result, a greater number of the plurality of apertures 616 of the ventilation region 614 of the accordion pleat 602 are exposed when the accordion pleat 602 is in a second, active state, as compared to the number of apertures 616 exposed when the accordion pleat 602 in the first, inactive state. Consequently, enhanced ventilation is provided by exposing a relatively greater number of apertures.

As can be appreciated, each of the pleats described herein may also be in an intermediate state. As described hereinabove, when a pleat is in the intermediate state, the pleat is open to a degree that is between the degree to which the pleat is open in the first state and the second state. Consequently, an intermediate level of ventilation is provided when in accordion pleat 602 is in the intermediate state.

Figure 20:
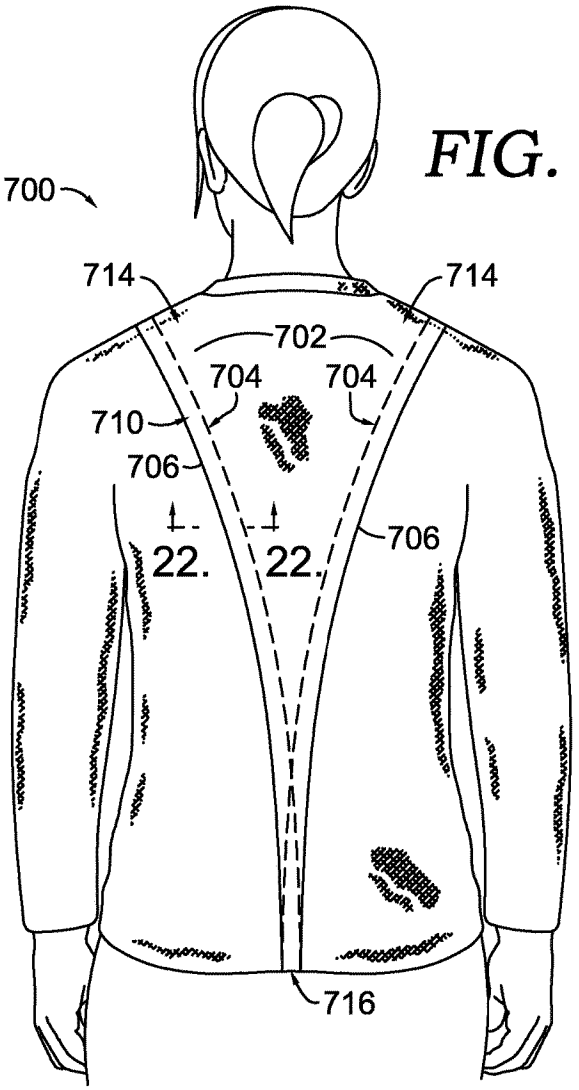
FIG. 20 illustrates a back view of an article of apparel in an as-worn state, where the article of apparel comprises an exemplary motion-activated venting system in the form of two knife pleats in a first, inactive state in accordance with an aspect herein.

FIG. 20 illustrates a back view of an article of apparel 700 in an as-worn state, where the article of apparel 700 comprises an exemplary motion-activated venting system in the form of two knife pleats 702 in a first, inactive state in accordance with an aspect herein. Each knife pleat 702 may comprise a first fold 704 terminating in a first edge 706, and a ventilation region 710 having a plurality of apertures 712 (shown in FIG. 21). Each knife pleat 702 additionally has an upper portion 714 and a lower portion 716. As shown in FIG. 20, when the knife pleat 702 is in a first, inactive state, the first folded edge 706 covers or substantially covers the ventilation region 710 having the plurality of apertures 712. The knife pleat 702 may be incorporated, for example, in an article of apparel 700 for the torso of a wearer, such as a shirt. As shown in FIG. 20, the knife pleat 702 may be diagonally oriented. For example, the upper portion 714 of the knife pleat 702 may be located at a portion of the shirt that corresponds to an area proximate the shoulder blade of a wearer, when the motion-activated venting system is incorporated into the shirt and the shirt is in an as-worn position. Continuing with this example, the lower portion 716 of the knife pleat 702 may be located at a portion of the shirt that corresponds to an area of the spine of the wearer. As is apparent, the location of the upper portion 714 and a lower portion 716 of the knife pleat 702 may be at any suitable location of a variety of articles of apparel. As is also apparent, the knife pleat 702 may be vertically oriented rather than diagonally oriented. The orientation of the pleats described herein may be modified to provide greater ventilation at regions of an article of apparel 700 corresponding to regions of the body of a wearer that produce or retain body heat.

Figure 21:
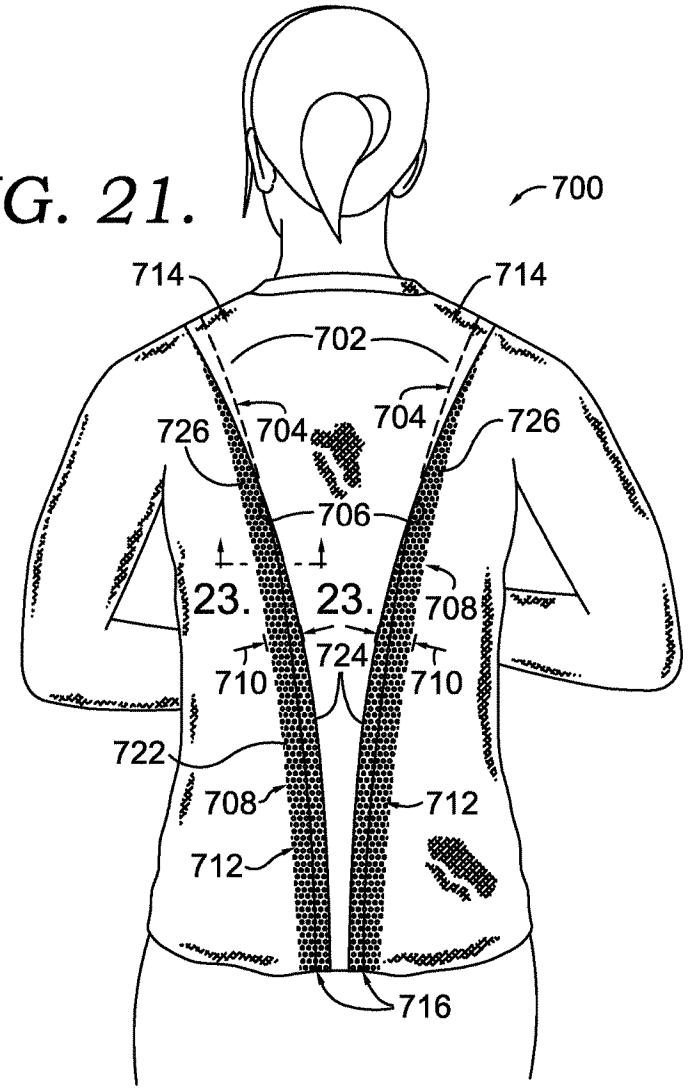
FIG. 21 illustrates the back view of the article of apparel of FIG. 20, where the exemplary motion-activated venting system is in a second, active state in accordance with an aspect herein.

FIG. 21 illustrates the back view of the article of apparel 700 of FIG. 20, where the exemplary motion-activated venting system is in a second, active state in accordance with an aspect herein. Each knife pleat 702 comprises the first fold 704 terminating in the first edge 706, the ventilation region 710, and a junction 708. The junction 708 refers to a portion of the knife pleat 702 where the ventilation region 710 abuts a body of the article of apparel 700. The ventilation region 710 comprises a plurality of apertures 712. The ventilation region 710 may be disposed between the first edge 706 and the junction 708. In other aspects, the ventilation region 710 may extend to the back panel of the article 700 and be overlaid by the first fold 704 and the first edge 706 in the first, inactive state. In exemplary aspects, the knife pleat 702 may have a ventilation region 710 width that is uniform throughout the length of the knife pleat 702. In other aspects, as shown in FIG. 21, the ventilation region 710 of the knife pleat 702 may have a ventilation region width at the upper portion 714 that is less than a ventilation region width at the lower portion 716 of the pleat, or vice versa (a pleat in this configuration may also be referred to as a bias pleat). The depiction of the number and location of the knife pleats 702 shown in FIGS. 20 and 21 is exemplary only and additional configurations are contemplated herein.

Figure 22:
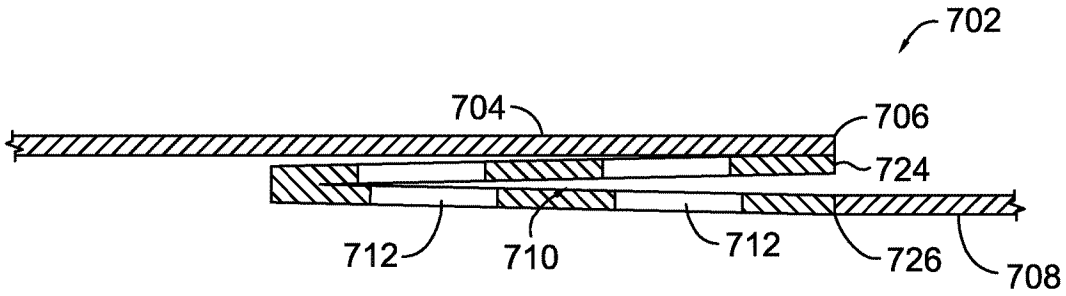
FIG. 22 illustrates a top-down cross-sectional view of one knife pleat aspect of the exemplary motion-activated venting system shown in FIG. 20, where the exemplary motion-activated venting system is in the first, inactive state in accordance with an aspect herein.

FIG. 22 illustrates a top-down cross-sectional view of one knife pleat 702 aspect of the motion-activated venting system shown in FIG. 20, in the first, inactive state in accordance with an aspect herein. The knife pleat 702 may include the first fold 704 terminating in the first edge 706, the ventilation region 710, and the junction 708. When the knife pleat 702 is in the first, inactive state, the ventilation region 710 is folded onto itself such that the first fold 704 and the first edge 706 overlie the ventilation region 710. A first portion 724 of the ventilation region 710 may be adjacent to and affixed to the first fold 704, or integrally manufactured with the first fold 704. A second portion 726 of the ventilation region 710 may be adjacent to and affixed to the body of the article of apparel 700 at the junction 708, or integrally manufactured with the body of the article of apparel 700. The ventilation region 710 comprises the plurality of apertures 712. When the knife pleat 702 is in the first, inactive state, the ventilation region 710 is covered by the first fold 704. As a result, the plurality of apertures 712 is unexposed, at least in part, when the knife pleat 702 is in the first, inactive state.

Figure 23:
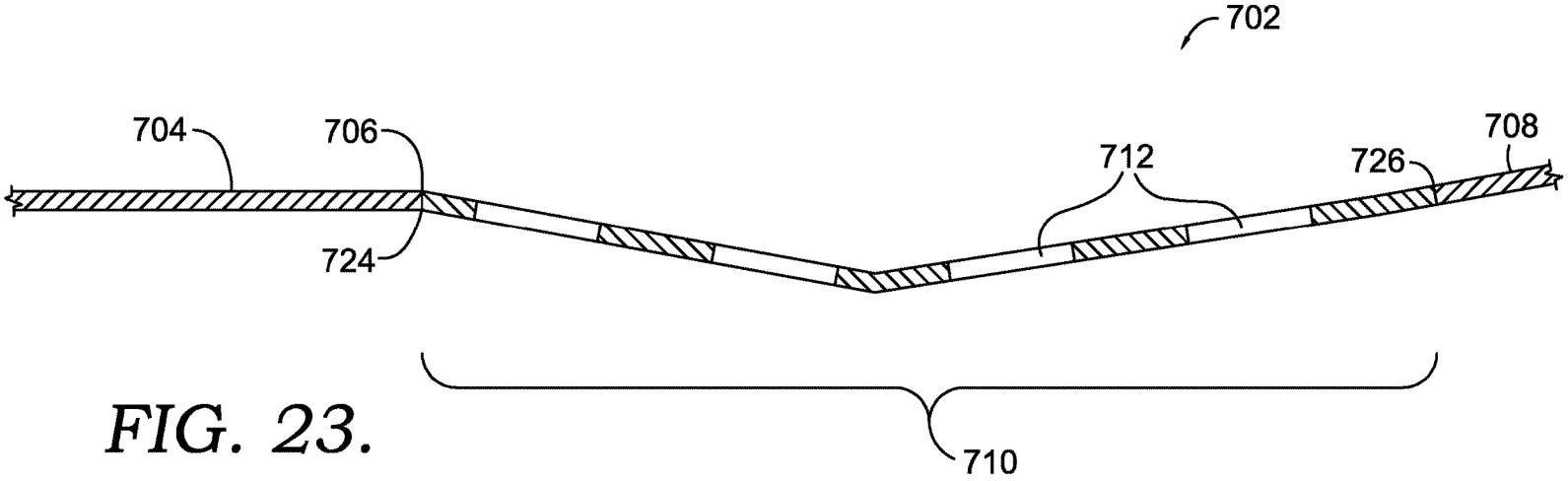
FIG. 23 illustrates a top-down cross-sectional view of one knife pleat aspect of the motion-activated venting system shown in FIG. 21, where the exemplary motion-activated venting system is in the second, active state in accordance with an aspect herein.

FIG. 23 illustrates a top-down cross-sectional view of the one knife pleat 702 aspect of the motion-activated venting system shown in FIG. 21, in the second, active state in accordance with an aspect herein. As shown in FIG. 23, the first fold 704 is more remote from the junction 708 when the knife pleat 702 is in the second, active state, as compared to the first fold 704 and the junction 708 of the knife pleat 702 when the knife pleat 702 is in the first, inactive state. As such, a greater surface area of the ventilation region 710 is exposed when the knife pleat 702 is in the second, active state. Consequently, a greater number of the plurality of apertures 712 is exposed when the knife pleat 702 is in the second, active state, as compared to the number of the plurality of apertures 712 of the knife pleat 702 when the knife pleat 702 is in the first, inactive state. The knife pleat 702 thereby provides enhanced ventilation by exposing the plurality of apertures 712 when the knife pleat 702 is in the second, active state. As will be apparent, the knife pleat 702 may additionally be embodied as a double knife pleat, similar to the double box pleat described hereinabove. In this aspect, the double knife pleat has multiple creases. Moreover, as described above, the knife pleat 702 may also be in an intermediate state where the ventilation region 710 is partially exposed.

Figure 24:
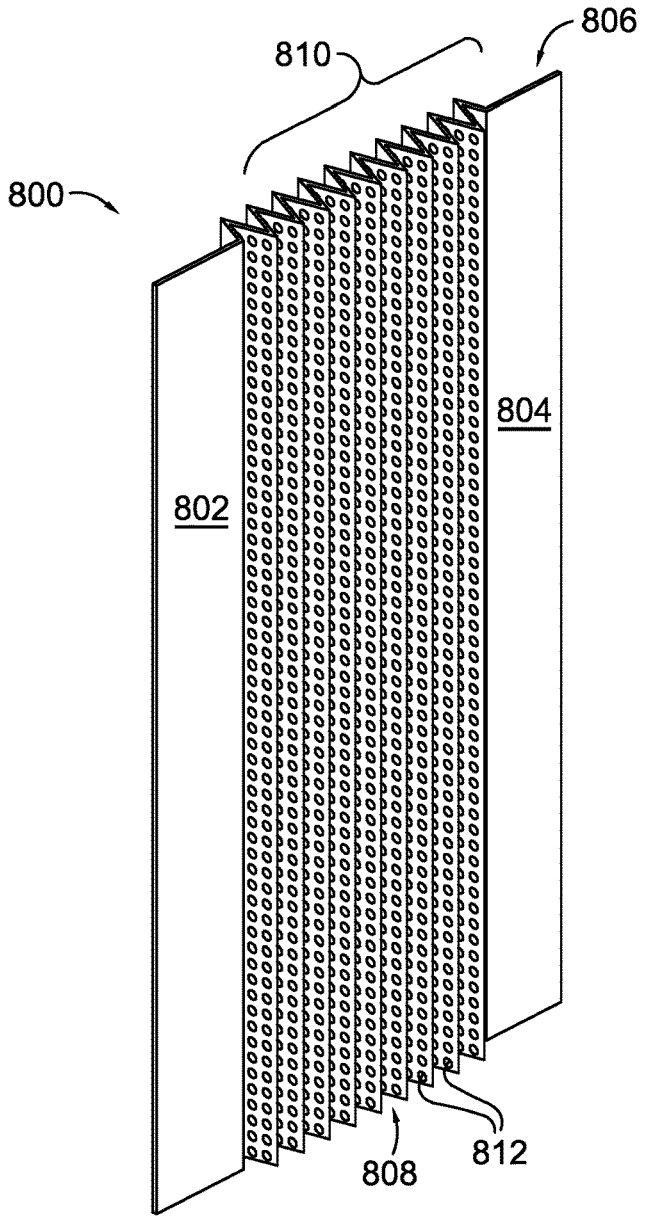
FIG. 24 illustrates a perspective view of an exemplary motion-activated vent insert in a first, inactive state in accordance with an aspect herein.

FIG. 24 illustrates a perspective view of an exemplary motion-activated vent insert 800 in a first, inactive state in accordance with an aspect herein. The insert 800 may be formed separately from an article of apparel and be incorporated into the article of apparel as a post-processing step using affixing technologies known in the art. Moreover, the vent insert 800 may be formed of different materials than the article of apparel into which it is to be incorporated. Any and all such aspects, and any variation thereof, are contemplated as being within the scope herein.

The insert 800 has a first side 802, a second side 804, a third side 806, a fourth side 808, and a pleat structure 810. Any of the pleats described hereinabove can be incorporated into the insert 800. FIG. 24 illustrates an exemplary accordion pleat structure 810 in a first, inactive state, described hereinabove, incorporated into the insert. The first side 802, the second side 804, the third side 806, and the fourth side 808 of the insert 800 are shown in FIG. 24 as being unaffixed to an article of apparel. However, the insert 800 is configured for incorporation into any suitable article of apparel. Moreover, the insert 800 may be incorporated into the article of apparel in a number of different orientations designed to, for example, take advantage of natural stress forces imposed on the article when the wearer is in motion. As an example, the insert 800 may be oriented such that the pleat structure 810 is aligned horizontally along its longitudinal axis to take advantage of vertical stress forces imposed on the article of apparel. Similarly, the insert 800 may be oriented such that the pleat structure 810 is aligned vertically to take advantage of horizontal stress forces imposed on the article of apparel. Any and all such aspects, and any variation thereof, are contemplated as being within the scope herein.

Continuing, the insert 800 may be incorporated into the article of apparel such that each of the different sides 802, 804, 806 and 808 are affixed to the article of apparel. Alternatively, one or more of the sides 802, 804, 806, or 808 may remain unaffixed to provide additional ventilation to the article of apparel. Moreover, by not affixing one or more of the sides 802, 804, 806 and 808 a greater degree of expansion of the ventilation region of the pleat 810 may be achieved, as compared to the degree of expansion when all of the sides 802, 804, 806 and 808 are affixed to the article. Similar to the pleat structures described hereinabove, the insert 800, when in a first, inactive state as shown in FIG. 24, has a plurality of apertures 812 that are generally not exposed. By configuring the insert 800 as described and incorporating it into an article of apparel, when the wearer of the article of apparel is in the first, inactive state, the plurality of apertures 812 is substantially unexposed or covered.

Figure 25:
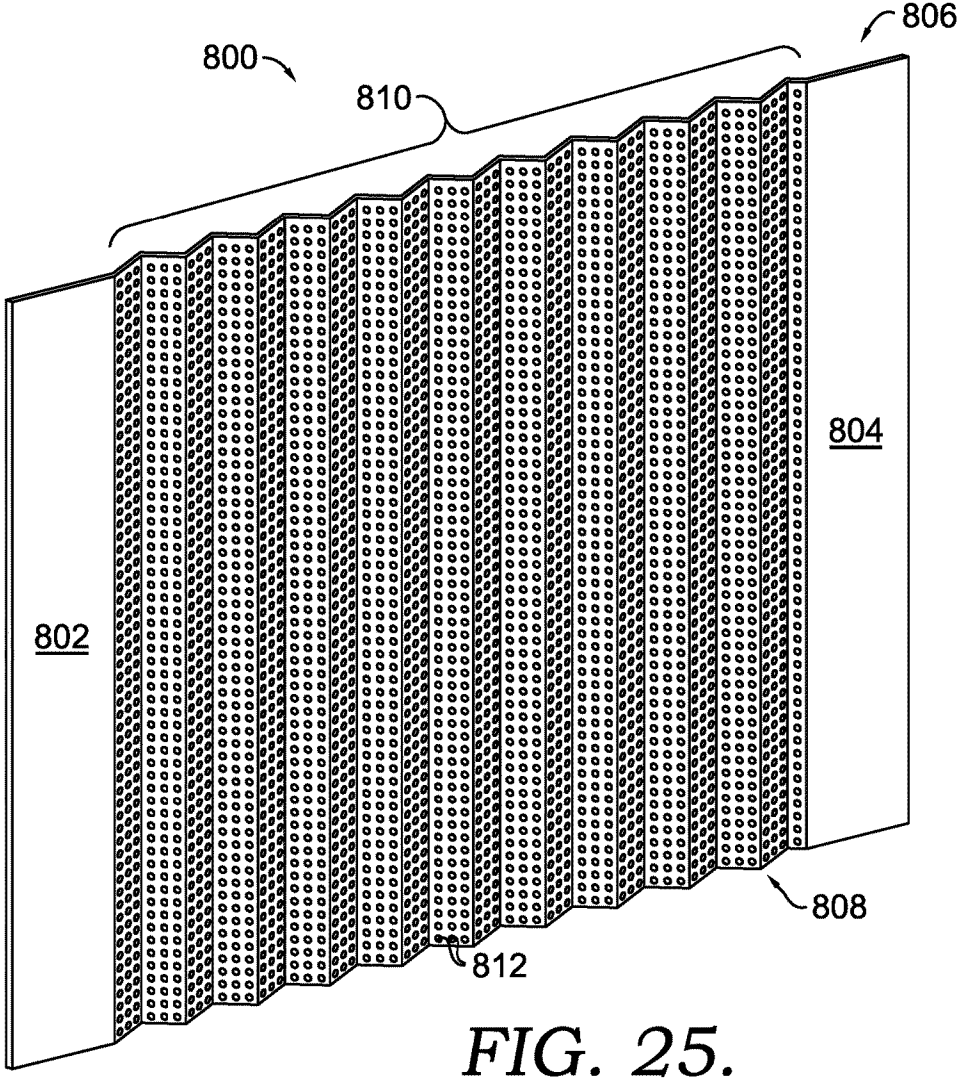
FIG. 25 illustrates the perspective view of the motion-activated vent insert of FIG. 24, where the exemplary motion-activated vent insert is in a second, active state in accordance with an aspect herein.

FIG. 25 illustrates the perspective view of the motion-activated vent insert 800 of FIG. 24, where the insert 800 is in a second, active state in accordance with an aspect herein. Accordingly, the plurality of apertures 812 of the pleat structure 810 of the insert 800 is exposed or uncovered, thereby providing enhanced ventilation. As will be apparent from the figures, the insert is well adapted for incorporation into any of a variety of articles of apparel.

Figure 26:
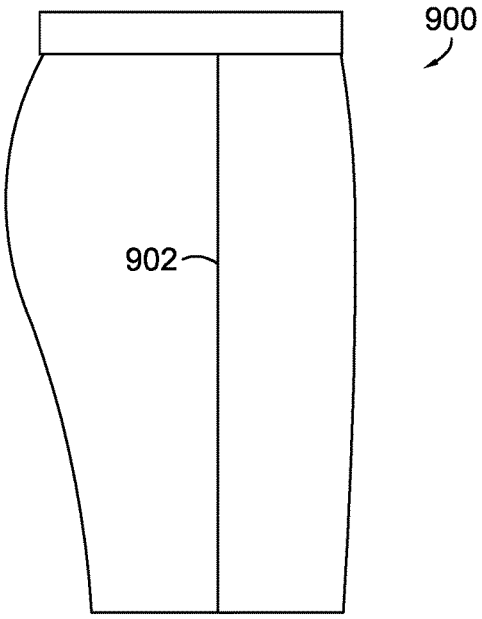
FIG. 26 illustrates a side view of a pair of shorts, where the shorts comprise an exemplary motion-activated venting system in the form of a box pleat in a first, inactive state in accordance with an aspect herein.
Figure 27:
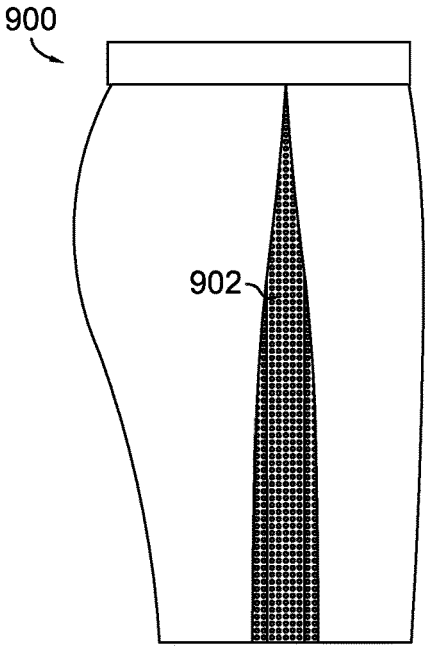
FIG. 27 illustrates the side view of the pair of shorts of FIG. 26, where the exemplary motion-activated venting system is in a second, active state in accordance with an aspect herein.
Figure 28:
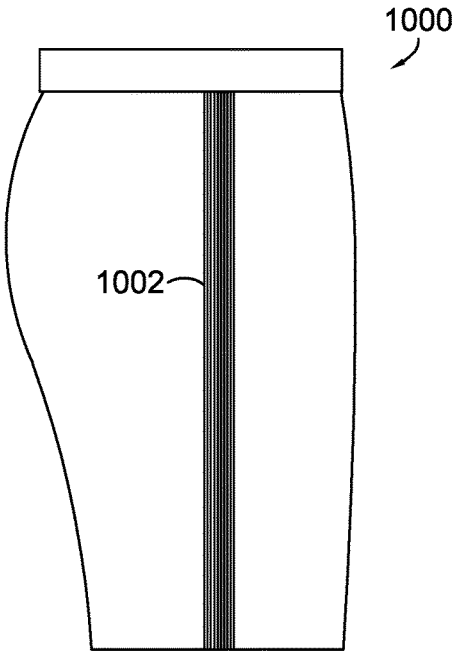
FIG. 28 illustrates a side view of a pair of shorts, where the shorts comprise an exemplary motion-activated venting system in the form of an accordion pleat in a first, inactive state in accordance with an aspect herein.
Figure 29:
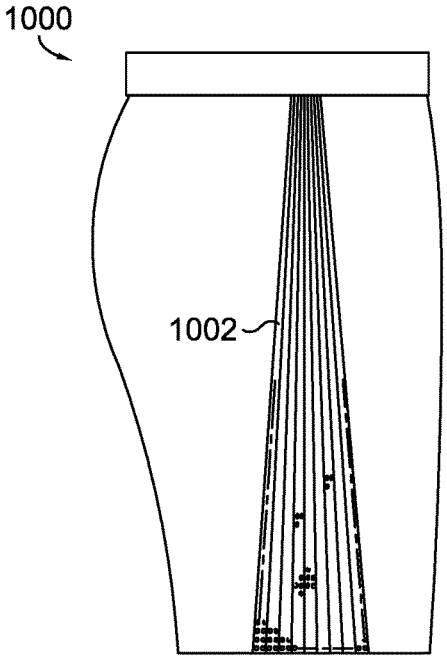
FIG. 29 illustrates the side view of the pair of shorts of FIG. 28, where the exemplary motion-activated venting system is in a second, active state in accordance with an aspect herein.

FIG. 26 illustrates a side view of a pair of shorts 900, where the shorts comprise a motion-activated venting system in the form of a box pleat 902 in a first, inactive state in accordance with an aspect herein. Although shown as a pair of shorts, the article 900 may be in the form of a pant, a capri, a three-quarter pant, and the like. FIG. 27 illustrates the side view of the pair of shorts 900 of FIG. 26 in a second, active state in accordance with an aspect herein. FIG. 28 illustrates a side view of a pair of shorts 1000, where the shorts comprise a motion-activated venting system in the form of an accordion pleat 1002 in a first, inactive state in accordance with an aspect herein. FIG. 29 illustrates the side view of the pair of shorts 1000 of FIG. 28 in a second, active state in accordance with an aspect herein. These figures demonstrate that each of the pleat structures of the motion-activated venting system described herein is well adapted for incorporation into a variety of articles of apparel.

Figure 30:
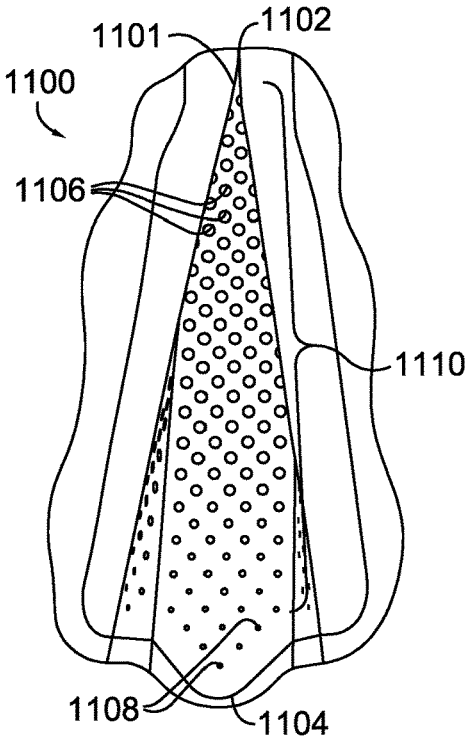
FIG. 30 illustrates a close-up view of an exemplary motion-activated venting system comprising a pleat structure, where a plurality of apertures of the pleat structure are arranged in a gradient, with larger apertures at an upper portion of the pleat structure and smaller apertures at a lower portion of the pleat structure in accordance with an aspect herein.

And briefly mentioned hereinabove, the various aspects of the motion activated venting systems described herein may include features that are modifiable and/or customizable. For example, FIG. 30 illustrates a close-up view of an exemplary motion-activated venting system 1100 comprising a pleat 1101, where a plurality of apertures 1110 of the pleat 1101 are in a gradient, with larger-sized apertures 1106 at an upper portion 1102 of the pleat 1101 and smaller-sized apertures 1108 at a lower portion 1104 of the pleat 1101. The diameters or sizes of the apertures 1110 may vary according to desired ventilation properties at a given location. For example, the diameters may decrease near the edges of the ventilation region, or the sizes of the apertures 1110 may be larger at portions of the ventilation region that correspond to locations of the body that generate a greater amount of heat or sweat. As can be appreciated the gradient in aperture sizes may be employed in an item of apparel with more than one pleat.

Figure 31:
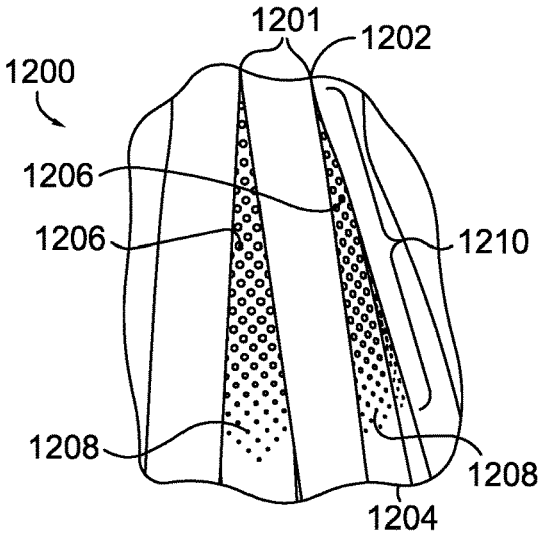
FIG. 31 illustrates a close-up view of an exemplary motion-activated venting system comprising at least two pleats in accordance with an aspect herein.

FIG. 31 illustrates a close-up view of an exemplary motion-activated venting system 1200 comprising at least two pleats 1201 that each includes a plurality of apertures 1210 in a gradient, with larger apertures 1206 at an upper portion 1202 of the pleats 1201 and smaller apertures 1208 at a lower portion 1204 of the pleats 1201.

Figure 32:
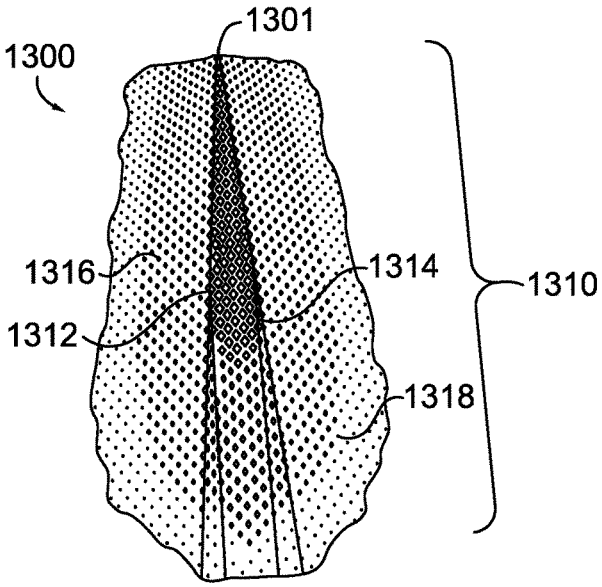
FIG. 32 illustrates a close-up view of an exemplary motion-activated venting system comprising a pleat structure, where a plurality of apertures of the pleat structure are a diamond shape and extend beyond a first edge and a second edge of the pleat structure to at least a portion of the a first fold and at least a portion of a second fold in accordance with an aspect herein.

FIG. 32 illustrates a close-up view of an exemplary motion-activated venting system 1300 comprising a pleat 1301 having a plurality of apertures 1310, where the plurality of apertures 1310 comprise a diamond shape. As will be appreciated, the apertures 1310 may be a variety of shapes, including squares, circles, rectangles, triangles, polygons, slits, or any other suitable shape. Additionally, in some aspects, the apertures 1310 and/or ventilation region may extend beyond a pleat to at least a portion of the article of apparel. For example, as illustrated in FIG. 32, the apertures 1310 may extend beyond a first edge 1312 and a second edge 1314 of the pleat 1301 to at least a portion of the a first fold 1316 and at least a portion of a second fold 1318.

Figure 33:
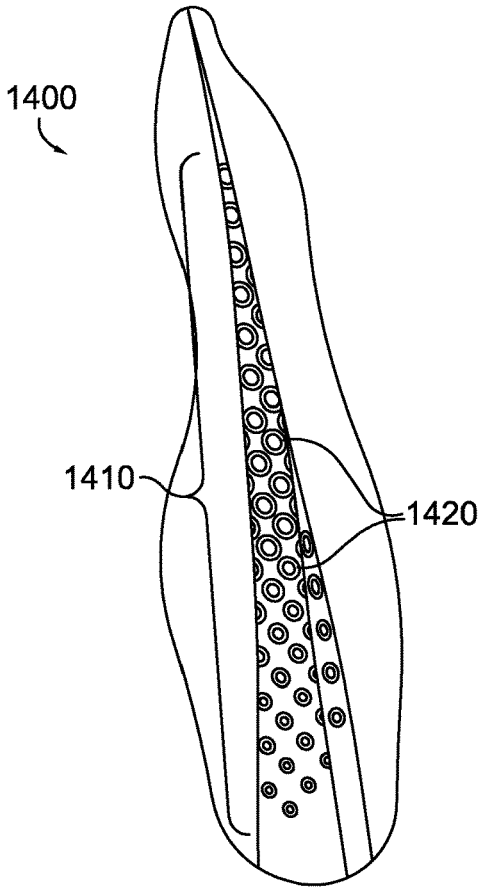
FIG. 33 illustrates a close-up view of an exemplary motion-activated venting system comprising a pleat structure, where a plurality of apertures of the pleat structure include a reinforcing material in accordance with an aspect herein.

FIG. 33 illustrates a close-up view of an exemplary motion-activated venting system 1400, having a plurality of apertures 1410 that include a reinforcing material 1420. For example, a perimeter of the apertures 1410 may be reinforced using resilient structural materials or substances like silicone or polyurethane. By way of further example, the apertures 1410 may be reinforced using stitching, grommets, or any other suitable structure around the apertures. In other aspects, a heat transfer material may be applied to a fabric and then cut (e.g., laser cut) to seal the edges of the apertures 1410. Reinforcing the apertures 1410 in this way reduces fraying and provides structural support around the apertures 1410. This may be particularly beneficial with woven or knit fabrics to reduce fraying, or in light-weight fabrics to increase support around the apertures 1410 and keep them open. Further, the reinforcing materials 1420 may also be reflective or have a different color than the fabric, so that visual effects are achieved when the vents open and close during motion. In this way, visibility of the wearer can be increased when the wearer is in motion. The reflective and/or different colors may also be implemented in other areas of the article of apparel, such as the entire ventilation region. Any and all such aspects, and any variation thereof, are contemplated as being within the scope herein.

Figure 35:
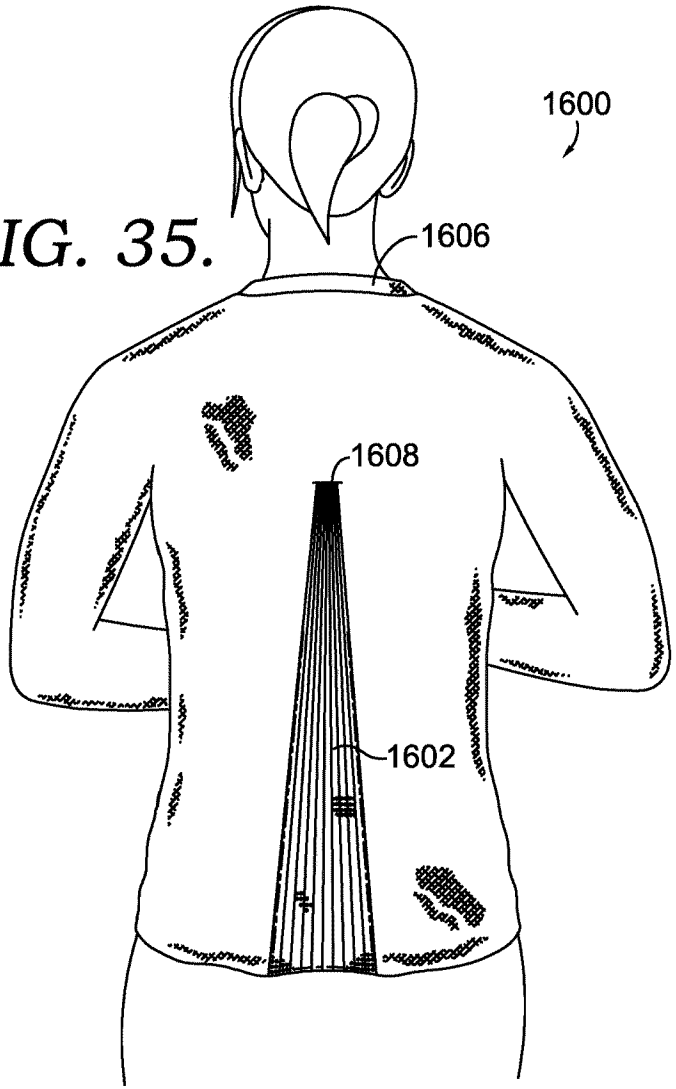
FIG. 35 illustrates a back view of an article of apparel in an as-worn state, where the article of apparel comprises an exemplary motion-activated venting system positioned a distance below a neck opening in a second, active state in accordance with an aspect herein.
Figure 34:
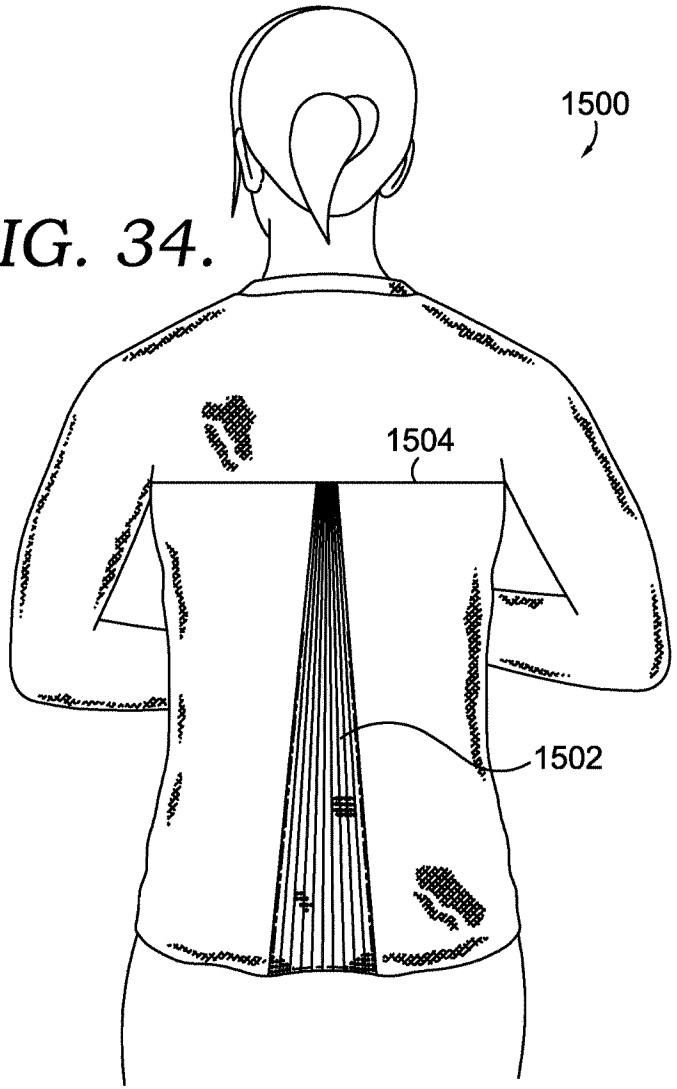
FIG. 34 illustrates a back view of an article of apparel in an as-worn state, where the article of apparel comprises an exemplary motion-activated venting system positioned below a back yoke of a shirt in a second, active state in accordance with an aspect herein.

The various aspects herein are configured for incorporation into any article of apparel. By way of example, the aspects described herein are configured for incorporation into shirts, jackets, coats, vests, shorts, pants, capri pants, half pants and three-quarter pants, among others. Further, the aspects described herein may be incorporated at any location of an article of apparel. For example, the various pleats/baffles described herein may be positioned, at a distance below the neck opening of a shirt (e.g., below a back yoke in a dress shirt). In exemplary aspects, the motion-activated venting systems and pleats may be located in a shirt, or any other type of top, at a back, a front, at a sleeve, at an elbow, at a portion of a sleeve corresponding to the triceps of a wearer, a portion of the sleeve corresponding to the bicep of a wearer, at the underarm, or the sides. In other aspects, the motion-activated venting systems and pleats may be located in a pant, or any other type of bottom, at a back, at a front, or the sides. Additionally, the motion-activated venting systems and pleats may be located at portions of the bottom corresponding to regions of the body of the wearer, the regions of the body including: buttocks, hamstrings, knees, back of the knees, front of the thigh, shin, or calf. By way of illustration, FIG. 34 shows a back view of an article of apparel 1500 in an as-worn state, where the article of apparel 1500 comprises an exemplary motion-activated venting system 1502 positioned below a back yoke 1504 of a shirt in a second, active state in accordance with an aspect herein. Further, FIG. 35 illustrates a back view of an article of apparel 1600 in an as-worn state, where the article of apparel 1600 comprises an exemplary motion-activated venting system 1602, with a top portion 1608 positioned a distance below a collar 1606 in a second, active state in accordance with an aspect herein. Accordingly, the various aspects described herein are well suited for incorporation in a variety of articles of apparel and at a variety of locations.

Figure 36:
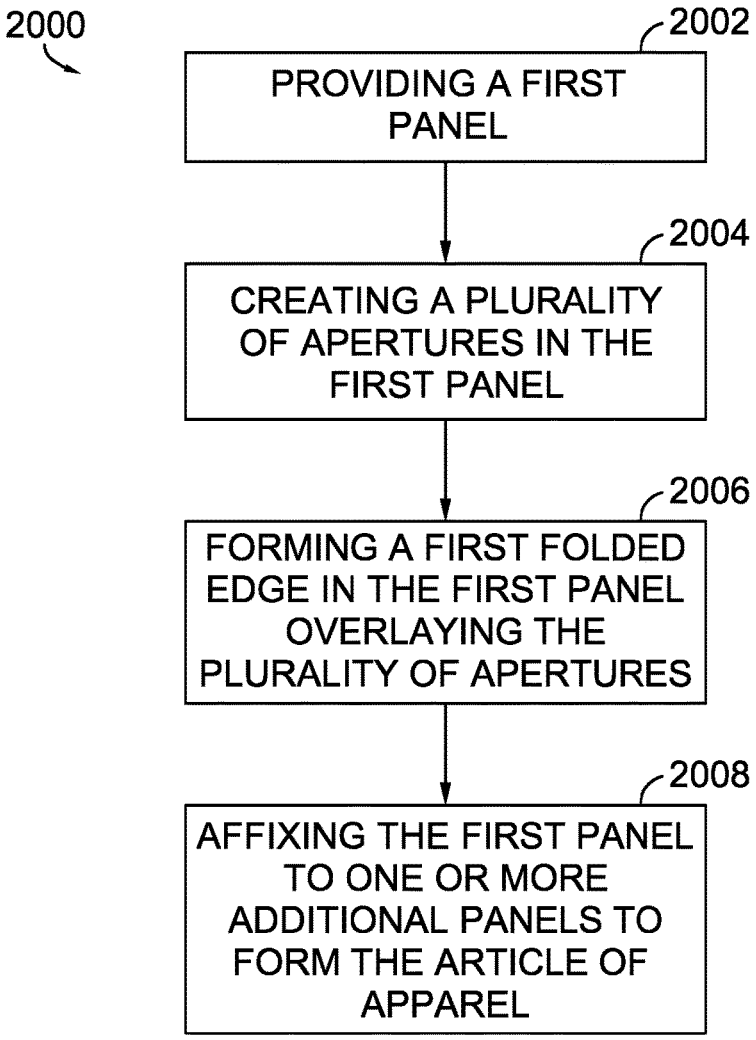
FIG. 36 illustrates a block diagram illustrating a method for manufacturing an article of apparel having a motion-activated venting system, in accordance with an aspect herein.

FIG. 36 illustrates a block diagram illustrating a method 2000 for manufacturing an article of apparel having a motion-activated venting system, in accordance with an aspect herein. At block 2002 at least a first panel of material is provided. At block 2004 a plurality of apertures is created in at least a portion of the first panel to form a ventilation portion. The plurality of apertures may be engineered from the fabric itself (i.e., integrally formed using a knitting or weaving process) or may be formed using one or more of a laser, a knife, a die cut, a hot knife, and a punch. At block 2006 at least a first fold having a first folded edge is formed in the first panel of material such that the first folded edge overlays the plurality of apertures in a first, inactive state. The method may further comprise forming one or more additional folds having additional folded edges and configuring the placement of the folds such that the folded edges overlie the plurality of apertures. Continuing at block 2008, the method may further comprise affixing the at least the first panel to one or more additional panels to form the article of apparel. Alternatively, the method 2000 may also be used to form a ventilation insert panel that is later incorporated into an article of apparel.

From the foregoing, it will be seen that aspects herein are well adapted to attain all the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since many possible aspects may be made without departing from the scope thereof, it is to be understood that all matter herein set forth or shown in the accompanying drawings is to be interpreted as illustrative and not in a limiting sense.

What is claimed is:

1. An article of apparel having a first motion-activated venting system, the article of apparel comprising:

a front panel adapted to cover a front torso of a wearer when the article of apparel is in an as-worn configuration; and a back panel adapted to cover a back torso of the wearer when the article of apparel is in the as-worn configuration, wherein the first motion-activated venting system is incorporated into at least one of the front panel or the back panel, the first motion-activated venting system convertible between a first inactive state and a second active state without the use of a coupling mechanism, the first motion-activated venting system comprising:

a first fold having a first folded edge;

a second fold opposite the first fold, the second fold having a second folded edge opposite the first folded edge; and a ventilation region interposed between the first fold and the second fold, the ventilation region having a plurality of apertures.

2. The article of apparel of claim 1, wherein when the first motion-activated venting system is in the first inactive state the first fold and the second fold cover the plurality of apertures, when the first motion-activated venting system is in the second active state the plurality of apertures is uncovered, and when the first motion-activated venting system is in an intermediate state a portion of the plurality of apertures is uncovered.

3. The article of apparel of claim 1, wherein the article of apparel further comprises one or more additional motion-activated venting systems.

4. The article of apparel of claim 3, wherein the article of apparel is one or more of a shirt, a jacket, a coat, or a vest.

5. The article of apparel of claim 4, wherein the one or more additional motion-activated venting systems are located at least at an underarm, a side, or a sleeve portion of the article of apparel.

6. The article of apparel of claim 1, wherein the first fold and the second fold are made from a first material and the ventilation region is made from a second material.

7. The article of apparel of claim 1, wherein the ventilation region has a higher concentration of the plurality of apertures at an upper portion of the article of apparel as compared to a concentration of the plurality of apertures at a lower portion of the article of apparel when the article of apparel is in the as-worn configuration.

8. The article of apparel of claim 1, wherein the first folded edge and the second folded edge are affixed to the article of apparel at an upper portion of the article of apparel when the article of apparel is in the as-worn configuration.

9. An article of apparel having a motion-activated venting system, the article of apparel comprising:

one or more panels of material, at least one of the one or more panels of material comprising one or more pleat structures, wherein each pleat structure of the one or more pleat structures comprises at least:

a first fold having a first folded edge;

a second fold having a second folded edge;

a ventilation region positioned intermediate the first fold and the second fold; and a plurality of apertures formed through at least a portion of the first fold and the ventilation region.

10. The article of apparel of claim 9, wherein when the one or more pleat structures are in a first inactive state the first fold covers the plurality of apertures, when the one or more pleat structures are in a second active state the plurality of apertures is uncovered, and when the one or more pleat structures are in an intermediate state a portion of the plurality of apertures is uncovered.

11. The article of apparel of claim 10, wherein at least a first pleat structure of the one or more pleat structures is in the first inactive state, and at least a second pleat structure of the one or more pleat structures is in the second active state at a given point in time, the second pleat structure having a location in the article of apparel different from a location in the article of apparel of the first pleat structure.

12. The article of apparel of claim 9, wherein the article of apparel is one or more of a shirt, a jacket, a coat, a vest, a short, a pant, a capri pant, a half pant, or a three-quarter pant.

13. The article of apparel of claim 9, wherein the article of apparel is a top and the one or more pleat structures are located at least at a back, a front, an underarm, a side, or a sleeve portion of the top.

14. The article of apparel of claim 9, wherein the article of apparel is a bottom and the one or more pleat structures are located at least at a front, a back, or a side portion of the bottom.

15. The article of apparel of claim 14, wherein the one or more pleat structures are located at a portion of the bottom corresponding to regions of a body of a wearer, the regions of the body of the wearer including: a buttocks region, a hamstrings region, a knees region, a back of the knees region, a front of a thigh region, a shin region, or a calf region.

16. The article of apparel of claim 9, wherein each pleat structure of the one or more pleat structures is diagonally oriented when the article of apparel is in an as-worn configuration.

17. The article of apparel of claim 9, wherein the one or more pleat structures comprise one or more of an accordion pleat, a knife pleat, or a bias pleat.

18. The article of apparel of claim 9, wherein the at least one of the one or more panels of material includes at least two pleat structures.

19. A method of manufacturing an article of apparel having a motion-activated venting system, the method comprising:

providing one or more panels of material;

forming a first fold in the one or more panels of material;

forming a second fold in the one or more panels of material, such that a ventilation region is positioned intermediate the first fold and the second fold; and forming a plurality of apertures in at least a portion of the first fold and in at least a portion of the ventilation region.

20. The method of manufacturing an article of apparel of claim 19, wherein the plurality of apertures is formed using one or more of a laser, a knife, a die cut, a hot knife, or a punch.

* * * * *